US007287342B2

(12) United States Patent
Keen

(10) Patent No.: US 7,287,342 B2
(45) **Date of Patent: *Oct. 30, 2007**

(54) SHOE WITH LACING

(75) Inventor: Martin Keen, Jamestown, RI (US)

(73) Assignee: The Timberland Company, Stratham, NH (US)

( * ) Notice: Subject to any disclaimer, the term of this patent is extended or adjusted under 35 U.S.C. 154(b) by 64 days.

This patent is subject to a terminal disclaimer.

(21) Appl. No.: 11/182,970

(22) Filed: Jul. 15, 2005

(65) Prior Publication Data

US 2007/0011910 A1 Jan. 18, 2007

(51) Int. Cl.
*A43C 11/00* (2006.01)

(52) U.S. Cl. ..... 36/50.1

(58) Field of Classification Search ..... 36/50.1, 36/50.5, 58.5

See application file for complete search history.

(56) References Cited

U.S. PATENT DOCUMENTS

| | | | |
|---|---|---|---|
| 58,364 | A | 10/1866 | Adams |
| 114,340 | A | 5/1871 | Prusha et al. |
| D35,490 | S | 12/1901 | Hatheway |
| D37,359 | S | 2/1905 | Borchardt |
| 1,022,808 | A | 4/1912 | Woods |
| 1,088,309 | A | 2/1914 | Weidt |
| 1,197,783 | A | 9/1916 | Winbray |
| 1,211,542 | A | 1/1917 | Carolin |
| 1,355,827 | A | 10/1920 | Finneran |
| 1,386,684 | A | 6/1921 | Bradford |
| 1,683,465 | A | 9/1928 | Hill |
| 2,143,556 | A | 1/1939 | Hodaly |
| 2,169,337 | A | 8/1939 | Davis |
| D135,155 | S | 3/1943 | Huff |
| 2,390,685 | A | 12/1945 | Benson |
| 2,496,782 | A | 2/1950 | Engel |
| D158,653 | S | 5/1950 | Fenlason |
| D163,359 | S | 5/1951 | Braun |
| 2,551,723 | A | 5/1951 | Camero |
| D163,615 | S | 6/1951 | Laughlin |
| 2,590,648 | A | 3/1952 | Pitz |
| 2,724,913 | A | 11/1955 | Russell |
| 2,773,317 | A | 12/1956 | Helle |
| 2,801,478 | A | 8/1957 | Gilbert |
| 3,002,297 | A | 10/1961 | Neilson |

(Continued)

FOREIGN PATENT DOCUMENTS

| | | |
|---|---|---|
| CH | 168117 | 3/1934 |

(Continued)

*Primary Examiner*—Ted Kavanaugh
(74) *Attorney, Agent, or Firm*—Lerner, David, Littenberg, Krumholz & Mentlik, LLP

(57) ABSTRACT

The present invention provides a wraparound lacing system for use in all manner of footwear. The lacing system includes a lace which encircles the upper and midsole of the article of footwear in a spiral, helical, coiled or similar wound wraparound pattern. The upper includes finger members which independently adjust to the contours of the wearer's foot while providing a snug and secure fit. The upper and midsole are integrally formed as a unitary structure. The housing of the upper and the midsole includes channels therein which receive the wraparound lace. The lace can be affixed at one or both ends to the midsole or to the upper. Removable lace end keepers on the upper permit the user to adjust the length of the lace.

39 Claims, 24 Drawing Sheets

U.S. PATENT DOCUMENTS 3,121,962 A 2/1964 Gullo
3,193,950 A 7/1965 Liou
3,663,679 A 5/1972 Barre et al.
4,107,857 A 8/1978 Devlin
4,227,322 A 10/1980 Annovi
4,245,408 A 1/1981 Larser et al.
4,294,023 A 10/1981 Banford
4,366,631 A 1/1983 Larsen et al.
4,530,171 A 7/1985 Zabala
4,535,554 A 8/1985 De Obaldia B.
4,592,154 A 6/1986 Oatman
4,616,430 A 10/1986 McQuiggin
4,619,058 A 10/1986 Gumbert
4,670,998 A 6/1987 Pasternak
4,794,706 A 1/1989 Puckhaber et al.
4,860,464 A 8/1989 Misevich et al.
4,942,678 A 7/1990 Gumbert
5,117,567 A 6/1992 Berger
5,184,378 A 2/1993 Batra
5,269,078 A 12/1993 Cochrane
5,271,130 A 12/1993 Batra
5,291,671 A 3/1994 Caberlotto et al.
5,349,764 A 9/1994 Posner
5,355,596 A 10/1994 Sussmann
5,363,571 A 11/1994 Montfort
5,371,957 A * 12/1994 Gaudio ..... 36/50.1
5,438,767 A 8/1995 Stein
D363,815 S 11/1995 Lucarelli
5,467,537 A 11/1995 Aveni et al.
5,651,195 A 7/1997 Clancy
5,657,557 A 8/1997 Hull et al.
5,659,982 A 8/1997 Muraoka et al.
5,678,325 A 10/1997 Davidowitz et al.
5,678,329 A 10/1997 Griffin et al.
5,718,066 A 2/1998 Chemello et al.
D392,453 S 3/1998 Bathum
5,737,854 A 4/1998 Sussmann
5,755,046 A 5/1998 Dodge
D394,947 S 6/1998 Avar
5,761,832 A 6/1998 George
5,785,909 A 7/1998 Chang et al.
5,791,021 A 8/1998 James
D399,342 S 10/1998 Carlson
5,836,090 A 11/1998 Smith
5,873,183 A 2/1999 Posner
D406,688 S 3/1999 Winters et al.
5,884,419 A 3/1999 Davidowitz et al.
5,943,793 A 8/1999 Clements
5,992,057 A 11/1999 Monti
6,029,376 A 2/2000 Cass
6,052,920 A 4/2000 Bathum
6,052,921 A * 4/2000 Oreck ..... 36/50.1
6,088,936 A 7/2000 Bahl
6,122,845 A 9/2000 Menghi
6,128,834 A 10/2000 Vecchiola et al.
6,128,835 A 10/2000 Ritter et al.
D433,220 S 11/2000 Fogg
6,148,544 A 11/2000 Keen et al.
D440,033 S 4/2001 Neely
D441,175 S 5/2001 Ritter et al.
6,237,249 B1 5/2001 Aguerre
6,237,250 B1 5/2001 Aguerre
6,282,817 B1 9/2001 Curet
6,286,233 B1 9/2001 Gaither
6,324,773 B1 12/2001 Gaither
6,378,230 B1 4/2002 Rotem et al.
6,467,194 B1 10/2002 Johnson
6,493,965 B1 12/2002 Bathum
6,499,234 B2 12/2002 Manzi
D475,180 S 6/2003 Cosentino
6,606,803 B1 8/2003 Ritter et al.
6,615,512 B2 9/2003 Sink
6,637,130 B2 10/2003 Urie et al.
6,689,300 B2 2/2004 Chang
6,694,641 B1 2/2004 Gill
D487,334 S 3/2004 Issler
D487,613 S 3/2004 Urie et al.
6,701,644 B2 3/2004 Oorei et al.
6,754,983 B2 6/2004 Hatfield et al.
6,787,089 B2 9/2004 Liu
D505,250 S 5/2005 Adams et al.
D509,049 S 9/2005 McClaskie
D511,883 S 11/2005 Matis
D513,838 S 1/2006 Birkenstock
D514,294 S 2/2006 Matis
D515,299 S 2/2006 Burg
D517,302 S 3/2006 Ardissono
2001/0025434 A1 10/2001 Fellouche
2002/0002781 A1 1/2002 Bouvier
2002/0078597 A1 6/2002 Burt
2003/0024135 A1 2/2003 Liu
2003/0041477 A1 3/2003 Liu
2003/0041478 A1 3/2003 Liu
2003/0066207 A1 4/2003 Gaither
2003/0131496 A1 7/2003 Nakano
2003/0167655 A1 9/2003 Sussman
2003/0182820 A1 10/2003 Fuerst et al.
2003/0226286 A1 12/2003 Pochatko
2004/0128863 A1 7/2004 Hong et al.
2004/0172851 A1 9/2004 Curet
2004/0181972 A1* 9/2004 Csorba ..... 36/50.1
2004/0226190 A1 11/2004 Elkington et al.
2004/0244226 A1 12/2004 Farys et al.
2004/0250445 A1 12/2004 Pritchett
2004/0250452 A1 12/2004 Farys
2004/0255486 A1 12/2004 Pawlus et al.
2005/0022427 A1 2/2005 Kerns et al.
2005/0060914 A1 3/2005 Fuerst
2005/0257399 A1 11/2005 Yu
2005/0268485 A1 12/2005 Sakai
2005/0274040 A1 12/2005 Fuerst

FOREIGN PATENT DOCUMENTS

EP 0301187 2/1989
FR 1026527 4/1953
FR 1037244 9/1953
FR 1049937 1/1954
FR 1204224 1/1960
FR 1281619 12/1961
JP 08131201 5/1996
WO WO-2004/043184 5/2004
WO WO-2005/009163 2/2005
WO WO-2005011424 2/2005

* cited by examiner 4B-4B

SHOE WITH LACING

CROSS-REFERENCE TO RELATED APPLICATION

This application is related to U.S. Design patent application Ser. No. 29/234,283, which issued as U.S. Pat. No. D528,270 on Sep. 19, 2006, filed concurrently herewith and entitled "SHOE WITH LACING," the entire disclosure of which is hereby expressly incorporated by reference herein.

BACKGROUND OF THE INVENTION

The present invention relates generally to footwear, and in particular to footwear that combines a one piece molded upper and midsole designed to contour to the wearer's foot with a unique wrap around lacing system. The footwear is particularly suited to water sports and other water-related activities, although the invention is not limited to any specific type of footwear or activity.

Conventional footwear has two primary elements, namely the upper and the sole structure. The upper is often made from leather, synthetic materials or a combination thereof. The upper is attached to the sole structure, forming a void or receptacle in the interior of the footwear for receiving and securing the foot to the footwear. The sole structure traditionally includes multiple layers of material commonly referred to as the midsole and the outsole.

Traditional water sport footwear are boat shoes, sandals, and wet boots. Unfortunately, each of these types of footwear has drawbacks that can detract from the pleasure of water-related activities. Commonly, boat shoes have waterproof leather uppers combined with rubber soled bottoms. There are several drawbacks for the water sport participant when using waterproof leather in water sports. For instance, it is common for the wearer to fully submerge his or her foot and footwear in water, or come into contact with enough water to saturate the interior of the shoe. The in-shoe experience of the wearer is lessened in terms of comfort as perspiration and externally introduced water can saturate the skin, which, in turn, may lead to skin irritation, fungal infections or other problems, let alone general discomfort. Although the upper is able to provide protection and the rubber outsole can provide traction on slippery, wet surfaces, the regulation of the in-shoe climate is limited due to the properties of the upper material as well as a lack of ventilation. This can make for a hot and unpleasantly wet foot experience.

In contrast to boat shoes, known water sport sandals offer the benefit of air circulation. However, such sandals typically do not provide the protection, stability or traction of a boat shoe. Wet boots have a rubber and neoprene construction that offers protection from sand, stones, sharp objects and cool water. Wet boots may be suitable for beach walks and water activities such as surfing. However, this conventional construction is not suitable for trekking in wet or hot environments. Neither is it suitable for use on slippery surfaces. Furthermore, known wet boots do not offer durability, traction or stability for rough terrain. Moreover, once water enters into a wet boot, it is difficult to evacuate the water without removing the wet boot from the wearer's foot.

Therefore, a need exists for a new type of footwear suitable for water-related activities and wet environments to overcome these and other problems.

SUMMARY OF THE INVENTION

The present invention includes articles of footwear that provide the durability, stability, traction, comfort and form fit for a multitude of activities, including activities that have a water element or aspect. Water related activities include, but are not limited to, sailing, trekking, hiking, fishing, river running, kayaking, golfing, walking, hiking, adventure racing, biathlons, triathlons, etc. The water element could be, for instance, due to the outside environment, or due to temperate environments which necessitate breathability and air circulation around the foot. Such breathability and air circulation is beneficial to the wearer by reducing the moisture level next to the skin created by the interior environment, in cold weather activities where protection from water and temperature is required, in warm environments where perspiration collects next to the skin, or in a combination of these environments and a variety of terrains. The present invention addresses the needs for a multitude of activities and overcomes the deficiencies of conventional footwear with a one piece upper and midsole construction in conjunction with a unique wrap around lacing system.

In accordance with an embodiment of the present invention, an article of footwear is provided, which comprises an outsole and a housing. The outsole has a first surface for contacting the ground and second surface remote from the first surface. The housing includes an integrally formed upper and midsole defining an enclosure for receiving a wearer's foot. The upper has medial and lateral sides and has at least one projection affixed to the midsole on the medial side and at least one projection affixed to the midsole on the lateral side. The upper includes a lace channel on the medial side and a lace channel on the lateral side. The midsole has a first surface adjacent the enclosure and a second surface remote from the enclosure and connected to the second surface of the outsole. The housing includes a base lace channel positioned below the first midsole surface. The base lace channel is coupled to the medial and lateral side lace channels.

In one alternative, the article of footwear further comprises an endcap disposed on the upper adjacent to either the medial side lace channel or the lateral side lace channel. In this case, the endcap is preferably removably disposed on the upper. Optionally, the article of footwear further comprises a lace wound through the base lace channel, the medial side lace channel and the lateral side lace channel from a first point of the housing to a second point of the housing. Here, a first end of the lace is desirably secured to the first point of the housing by the endcap. The lace is desirably wound in a spiral configuration around the housing.

In an example, the base lace channel includes a recess at one end thereof for receiving a second end of the lace. In another example, the upper further comprises a heel support having a heel lace channel therein with the lace also being wound through the heel lace channel.

In yet another example, the base lace channel, the medial side lace channel and the lateral side lace channel each comprise a plurality of lace channels. Here, the lace is wound through each of the base, medial side and lateral side lace channels. In this case, the article of footwear may further comprise a second endcap for securing a second end of the lace. The first endcap is disposed on the upper adjacent to a first one of the medial or lateral side lace channels, and the second endcap is disposed on the upper adjacent to a second one of the medial or lateral side lace channels. Desirably, the article of footwear may further comprise a midpoint cap disposed on the upper adjacent to a second one of the medial or lateral side lace channels between the first and second endcaps. Here, a first segment of the lace between the first endcap and the midpoint cap has a first lace pressure and a second segment of the lace between the midpoint cap and the second endcap has a second lace pressure. In another example, the medial and lateral projections may each comprise a plurality of projections. In this case, each of the medial side projections preferably includes a corresponding one of the medial side lace channels and each of the lateral side projections preferably includes a corresponding one of the lateral side lace channels. The number of medial side projections may be different from the number of lateral side projections.

In a further alternative, the second surface of the outsole is preferably bonded to the second surface of the midsole with a bonding agent. In this case, the base lace channel is disposed in the second surface of the midsole, and the second surface of the outsole includes a bonding identifier positioned complementary to the base lace channel to identify a region of the second surface of the outsole that is not coated with the bonding agent. In yet another alternative, the base lace channel is molded into the second surface of the midsole and the second surface of the outsole includes a molded channel aligned with the base lace channel.

In another alternative, a lace is wound through the base lace channel, the medial side lace channel and the lateral side lace channel from a first point of the housing to a second point of the housing to substantially encircle the wearer's foot. Tension of the lace may be adjusted by un-securing the endcap, changing the length of the lace, and re-securing the first end of the lace with the endcap. In a further alternative, a lace is wound through the base lace channel, the medial side lace channel and the lateral side lace channel from a first point of the housing to a second point of the housing to substantially encircle the wearer's foot. Here, tension of the lace may be adjusted by winding or unwinding the lace with the endcap.

In yet another alternative, a first portion of the medial side lace channel is disposed along an outer surface of the medial side projection and a second portion of the medial side lace channel is disposed along an inner surface of the medial side projection, and a first portion of the lateral side lace channel is disposed along an outer surface of the lateral side projection and a second portion of the lateral side lace channel is disposed along an inner surface of the lateral side projection. Preferably, the base lace channel connects to the medial and lateral side lace channels to form a continuous lace channel.

In accordance with another embodiment of the present invention, an article of footwear comprising an outsole, a housing and a lace is provided. The outsole has a first surface for contacting the ground and second surface remote from the first surface. The housing includes an integral upper and midsole defining an enclosure for receiving a wearer's foot. The upper has at least one medial side projection and at least one lateral side projection extending away from the midsole, the at least one medial and lateral side projections each including a channel therein. The midsole has a first surface remote from the enclosure and connected to the second surface of the outsole. The midsole includes at least one channel therein. The at least one midsole channel connects to the at least one medial channel and the at least one lateral side channel. The lace is wound through the at least one midsole channel, the at least one medial side channel and the at least one lateral side channel from a first point of the housing to a second point of the housing to generally surround and encircle the wearer's foot. A first end of the lace is secured to a first connection point on the housing and a second end of the lace is secured to a second connection point on the housing.

In a preferred alternative, the article of footwear is a water shoe. In another alternative, the first and second connection points are disposed in the midsole. In yet another alternative, the article of footwear further comprises an endcap disposed on the upper adjacent to one of the medial side channel or the lateral side channel for securing the first end of the lace at the first connection point. In this case, the endcap is preferably coupled to the upper so that tension of the lace may be adjusted. In another example, the article of footwear further comprises a lace keeper removably coupled to the lace adjacent to one of the medial or the lateral side channels between the first and second connection points for adjusting tension of the lace.

In yet another alternative, the outsole is integrally molded with the housing. In a further alternative, the article of footwear further comprises a stiffening member disposed between the midsole and the outsole. In another alternative, the first surface of the outsole includes quad cut siping for wet and dry traction. In another alternative, the upper includes an integral toe guard that substantially covers the toes of the wearer's foot. In this case, the toe guard preferably includes a screen disposed over a ventilation hole to prevent entry of debris into the enclosure.

In a further alternative, the article of footwear further comprises a footbed for contacting the wearer's foot. The footbed is disposed in the enclosure over a second surface of the midsole. In one example, the footbed is removable. In another example, the footbed and the midsole form an integrally formed unitary structure.

In another alternative, the article of footwear further comprises a toe stem including a base and a separate top. The base has a pedestal disposed in the midsole and a tubular body connected to the pedestal. The top is disposed in one of the medial side projection or the lateral side projection and having a through-hole therein. The lace is run through the tubular body of the base and the through-hole of the top to connect the base and the pedestal.

In accordance with yet another embodiment of the present invention, a article of footwear is provided. The article of footwear comprises an outsole, a housing, a lace, a footbed, and an endcap. The outsole has a first surface for contacting the ground and second surface remote from the first surface. The housing includes an integral upper and midsole defining an enclosure for receiving a wearer's foot. The upper has a heel support, a toe cover and a plurality of medial side projections and a plurality of lateral side projections extending away from the midsole. At least some of the medial and lateral side projections including channels therein. The heel support includes a channel therein. The midsole has a first surface adjacent the enclosure and a second surface remote from the enclosure and connected to the second surface of the outsole. The midsole includes a plurality of channels therein. The lace is wound generally in a spiral pattern through the heel support channel, the midsole channels, the medial side channels and the lateral side channels from a first point of the housing to a second point of the housing to generally surround and encircle the wearer's foot. The first end of the lace is positioned at a first connection point on the housing and a second end of the lace is positioned at a second connection point on the housing. The footbed is disposed over the first surface of the midsole. The endcap is disposed on the upper adjacent to one of the medial side or lateral side channels at the first connection point. The first end of the lace is secured at the first connection point by the endcap.

In an alternative, the article of footwear further comprises a bootie generally disposed within the enclosure and adapted to substantially encompass the wearer's foot. The bootie includes a bottom surface positioned over the midsole and sidewalls attached to the bottom surface. The footbed is removably positioned within the bootie. In one example, the bootie is removable. In another example, the bootie further includes at least one finger pull that enables the wearer to pull the article of footwear on or off or to remove the bootie from the article of footwear.

In another alternative, the article of footwear further comprises at least one of a lace pull and a lace lock attached to the lace. The lace pull is operable to secure a portion of the lace to the article of footwear, and the lace lock is operable to adjust tension of the lace.

DETAILED DESCRIPTION

Figure 1A:
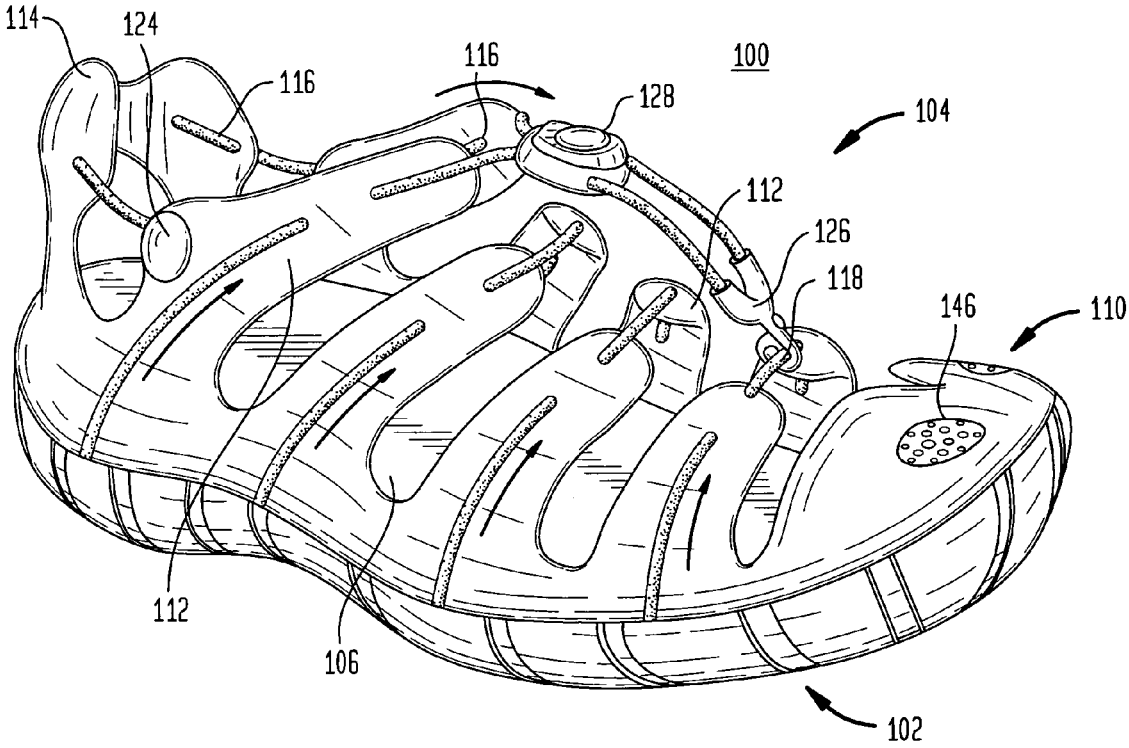
FIGS. 1(*a*)-(*g*) illustrate an article of footwear having a sandal configuration in accordance with aspects of the present invention.
Figure 1B:
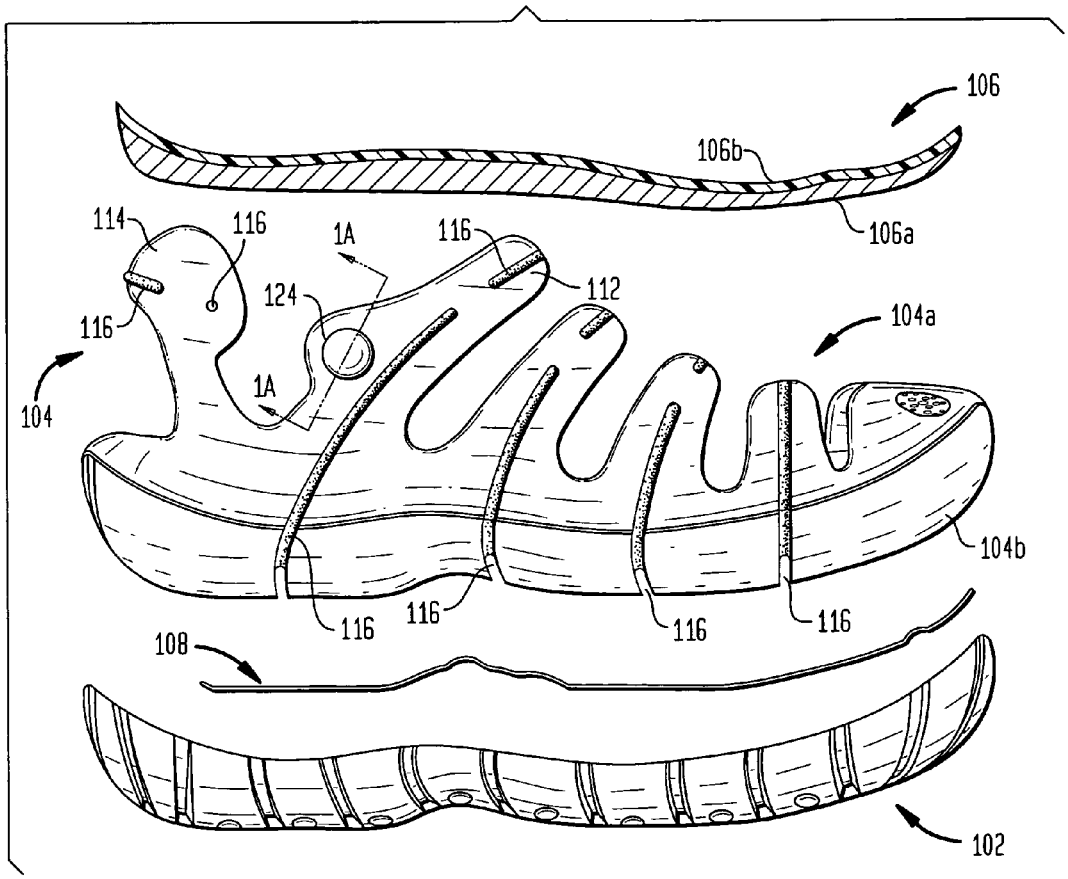
Figure 1C:
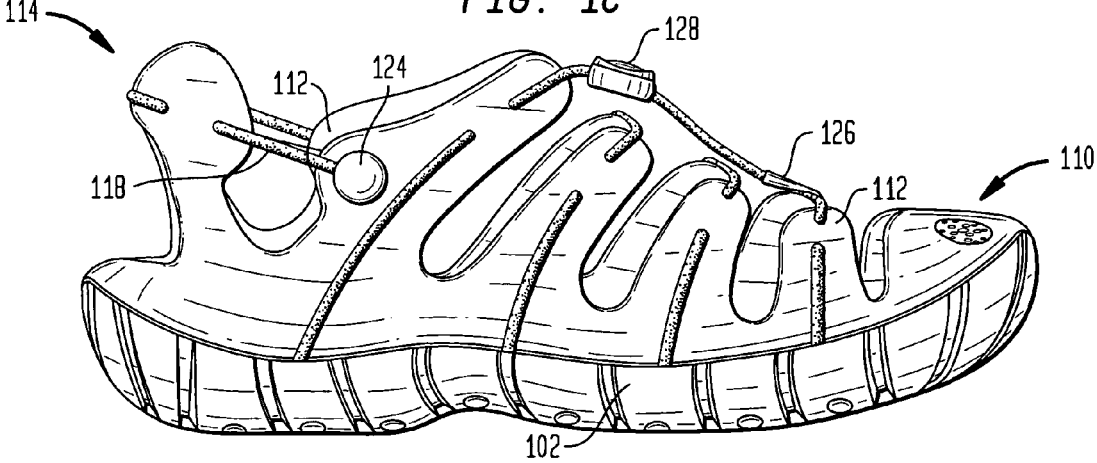
Figure 1D:
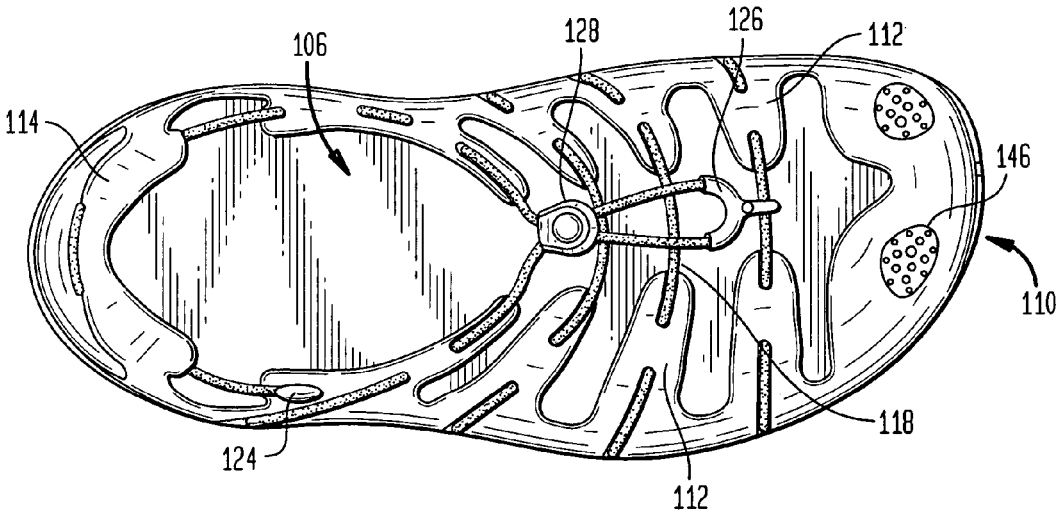
Figure 1E:
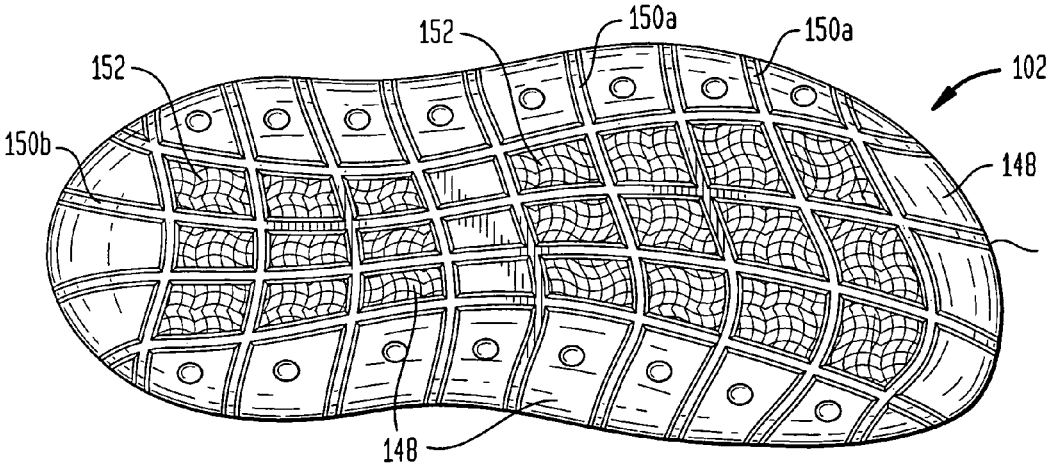
Figure 1F:
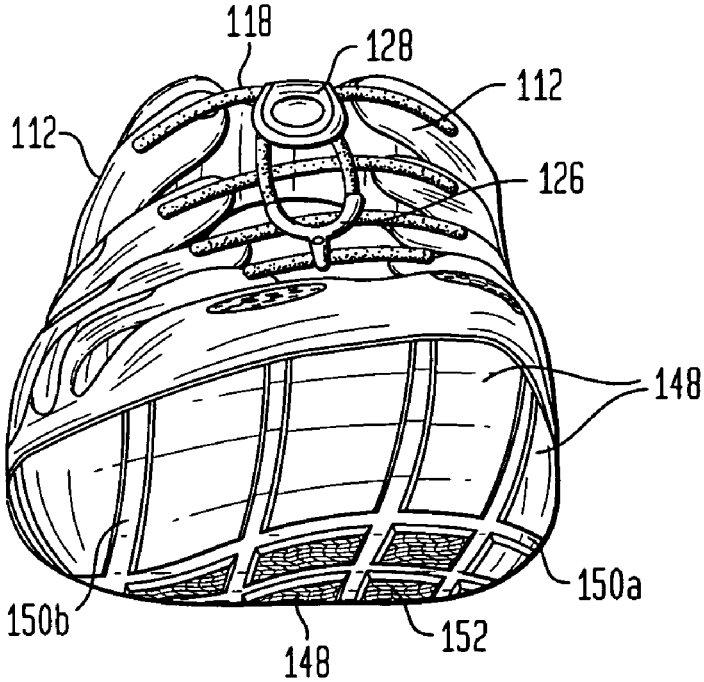
Figure 1G:
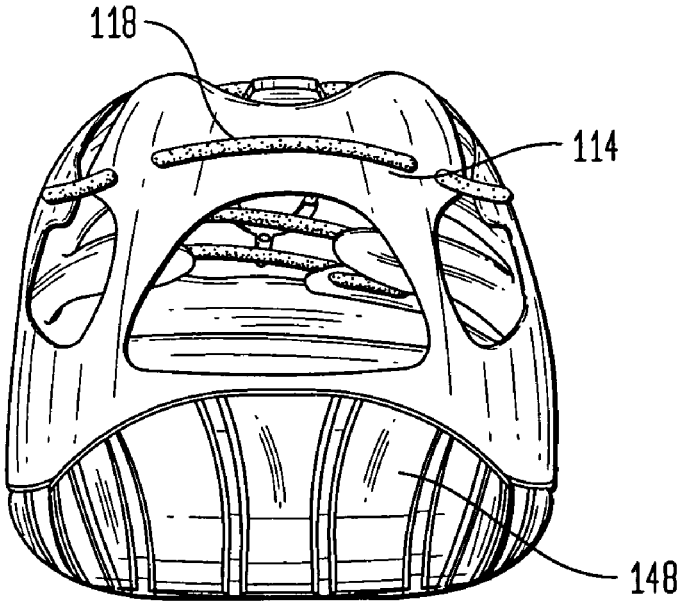
Figure 2A:
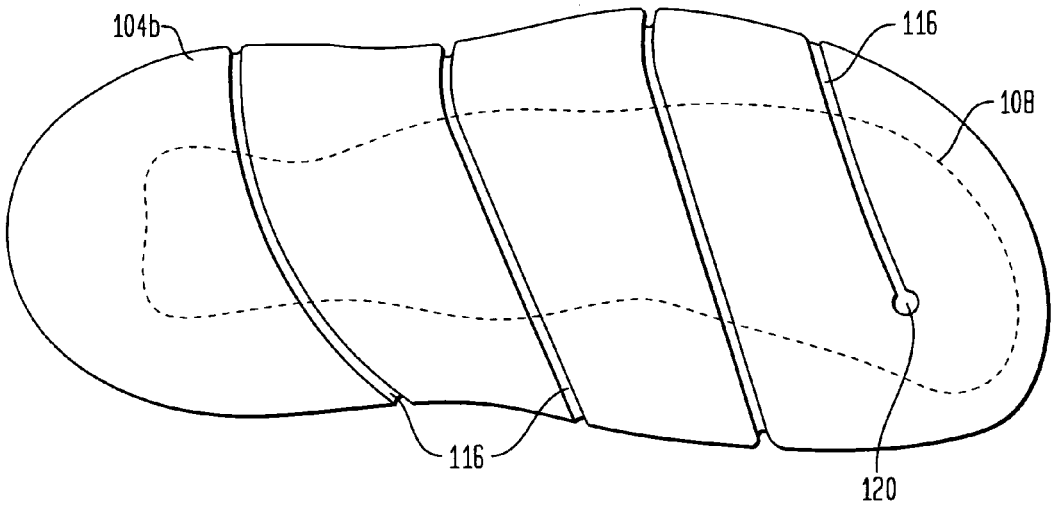
FIGS. 2(*a*)-(*f*) illustrate views of portions of the article of footwear of FIGS. 1(*a*)-(*f*).
Figure 2B:
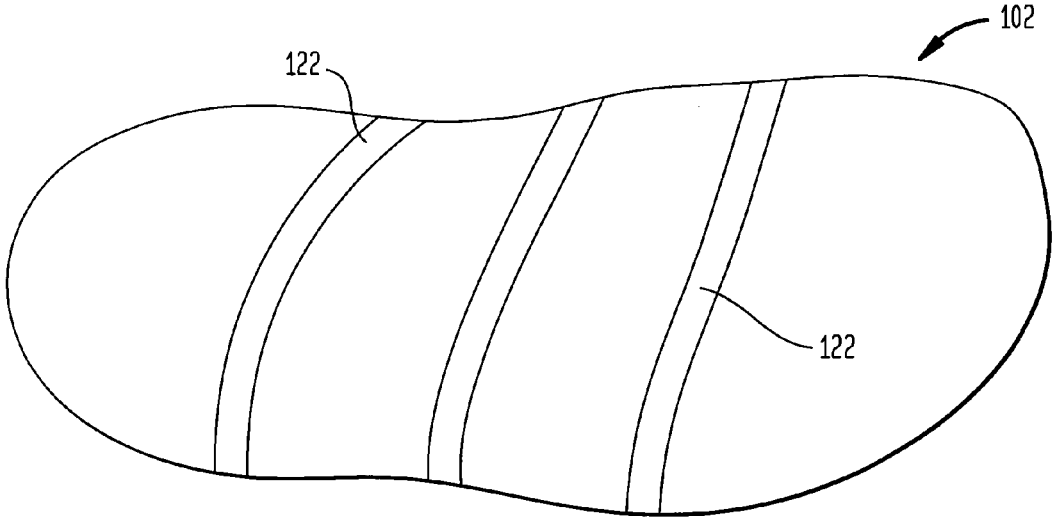
Figure 2F:
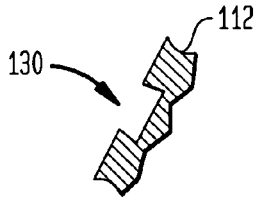
Figure 2C:
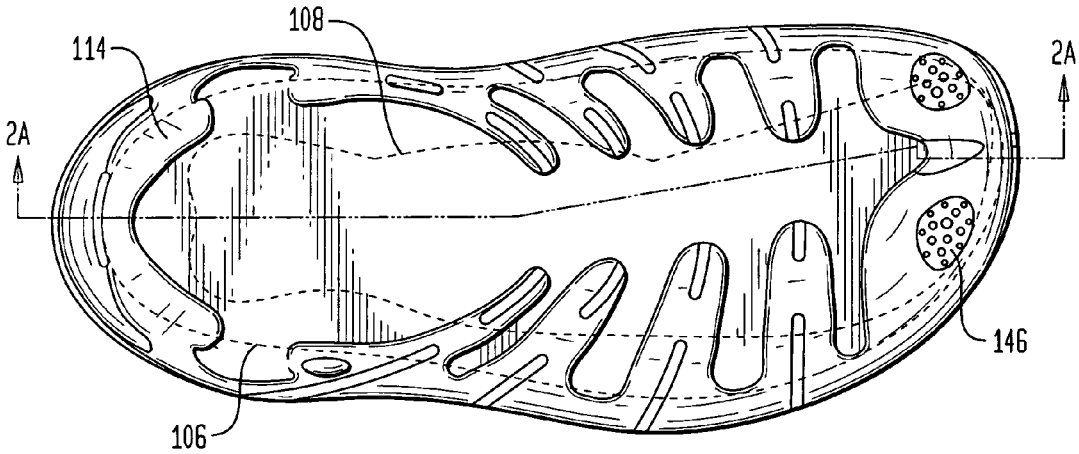
Figure 2D:
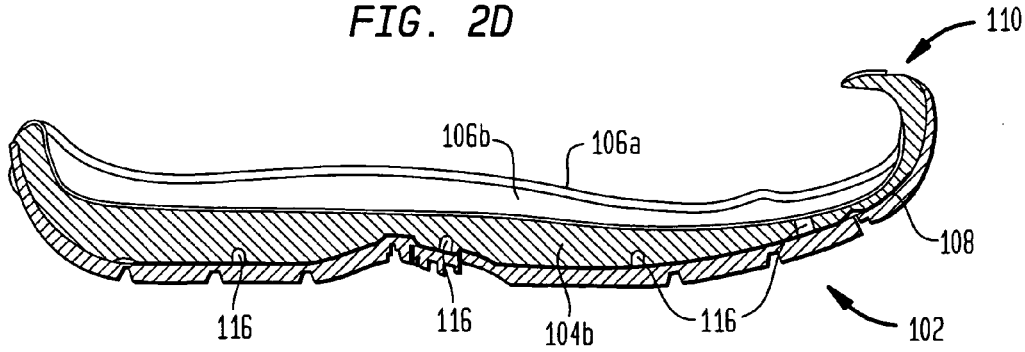
Figure 2E:
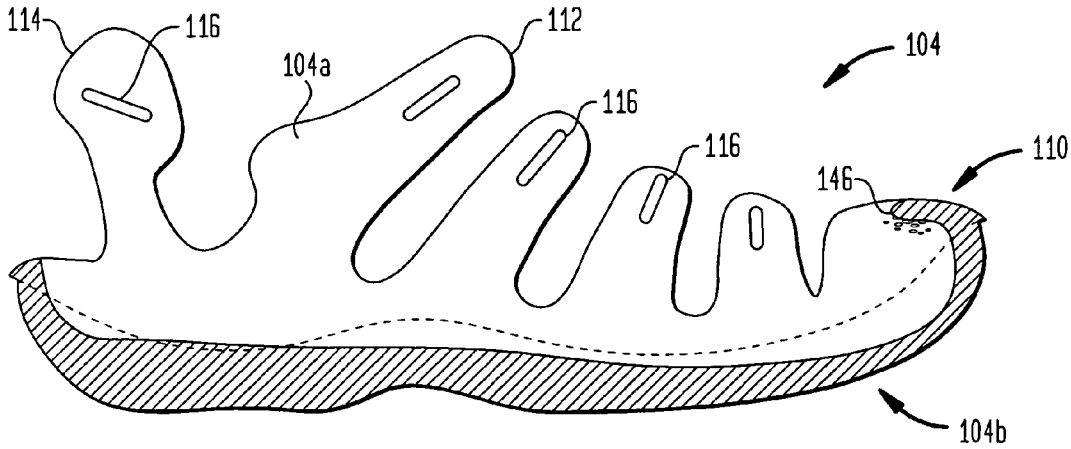

The foregoing aspects, features and advantages of the present invention will be further appreciated when considered with reference to the following description of preferred embodiments and accompanying drawings, wherein like reference numerals represent like elements. In describing the preferred embodiments of the invention illustrated in the appended drawings, specific terminology will be used for the sake of clarity. However, the invention is not intended to be limited to the specific terms used, and it is to be understood that each specific term includes equivalents that operate in a similar manner to accomplish a similar purpose. By way of example only, the term "footwear" is used herein to include, without limitation, all manner of foot coverings such as boots, shoes, sandals, athletic sneakers, loafers, boat shoes, wet boots, etc. The term "water shoes" includes sandals and sandal-type shoes such as slides, flips and thongs, as well as boat shoes, wet boots and other footwear adapted for water-related activities. In the embodiments of footwear shown in the drawings, only right foot shoes are shown. However, it should be understood that the left foot shoes are mirror images of the right foot shoes.

FIG. 1(*a*) illustrates a perspective view of an article of footwear 100 in accordance with aspects of the present invention, for example, in a sandal configuration. The article of footwear 100 comprises two main components, an outsole 102 and a once piece molded housing 104. The outsole 102 provides a ground contacting surface. The housing 104 provides a receptacle or enclosure for receiving a wearer's foot. As seen in the exploded view of FIG. 1(*b*), the unitary housing 104 includes upper 104*a* and midsole 104*b* portions. The features of the outsole 102 and the housing 104 will be described in more detail below.

FIG. 1(*b*) also shows that a footbed 106 may be disposed over the midsole 104*b* to provide cushioning, support and/or protection underneath the foot. The footbed 106 may be a separate component from the unitary housing 104. In this case, the footbed 106 may be removable from the article of footwear 100, or may be permanently, securely affixed to the midsole 104*b* using an adhesive or other bonding agent. Alternatively, the footbed 106 may be integrally formed as part of the housing 104, for instance as one or more layers of the midsole 104*b*. The footbed 106 may be formed from resilient materials such as ethyl vinyl acetate ("EVA") or polyurethane ("PU") foams or other such materials commonly used in shoe midsoles, insoles or sockliners.

The footbed 106 may be formed of one or more material layers, regions and/or segments, which may each have a different thickness and/or a different rigidity. For example, the footbed 106 may comprise multiple layers of different rigidity. Alternatively, the footbed 106 may have different levels of rigidity in the forefoot, instep and heel regions, respectively. The footbed 106 could also have a first segment about the first metatarsal on the medial side of the forefoot of a first rigidity and a second segment about the fifth metatarsal on the lateral side of the forefoot of a second rigidity. As shown in FIG. 1(*b*), the footbed 106 is preferably removable, and desirably includes two or more layers such as layers 106*a* and 106*b*. In a preferred example, the layer 106*a* comprises EVA foam such as compression molded EVA ("CMEVA"), and the layer 106*b* includes an antimicrobial component.

A stiffening member 108 may optionally be included in the article of footwear 100. The stiffening member 108 may be disposed, for example, between the midsole 104*b* and the outsole 102. Alternatively, the stiffening member 108 may be positioned between the footbed 106 and the midsole 104*b* may be integral with the footbed 106 or integral with the midsole 104*b*. The stiffening member 108 can be made from one or more different materials, including thermoplastic polyurethane ("TPU"), polyolefin, nylon, etc. A main function of the stiffening member 108 is to distribute or dissipate forces (e.g., when the wearer is running) across the midsole 104*b*, the outsole 102 and/or the footbed 106 and to provide a more stable platform for locomotion. Depending upon its placement, the stiffening member 108 may be contoured on one or both of its upper and lower surfaces to fit the contours of the components above and below it. For example, as seen in FIG. 1(*b*), the stiffening member 108 may be contoured in the instep region to fit the contours of the outsole 102 and the midsole 104*a*.

The outsole 102 is desirably formed of a natural or synthetic rubber, although other known outsole materials may be used. The outsole 102 preferably covers all or substantially all of the entire outside surface of the midsole 104*b* remote from the wearer's foot. Specifically, a first or inner surface of the outsole 102 may be bonded or otherwise attached to an exterior surface of the midsole 104*b*. A second or outer surface of the outsole 102 is the ground contacting surface, which may have a variety of tread and/or lug configurations, as will be illustrated below.

The housing 104 will now be described in more detail. Preferably, the one-piece construction is achieved using an injection molding process. For example, the upper 104*a* and the midsole 104*b* may comprise injection-molded EVA ("IMEVA") that is fabricating using known molding processes. However, other materials and/or processes may be used alone or in combination to form the one piece upper 104*a* and midsole 104*b*. Such materials include, but are not limited to, polyester and polyester based polyurethane ("PU"), rubber, plastics, etc.

The upper 104*a* desirably includes a toe cover 110, one or more projections, branches, or fingers 112, and a heel support 114, which are illustrated in the side and top views of FIGS. 1(*c*) and 1(*d*), respectively. The toe cover 110 is designed to provide protection to the wearer's toes. The fingers 112 and the heel support 114 are part of a one piece or unitary wraparound lacing system which secures the article of footwear 100 to the wearer's foot, as will be explained in more detail below. While four fingers 112 are shown on both the medial and lateral sides of the article of footwear 100, any number of fingers 112 may be used on the medial and lateral sides, including a single finger 112 on each side or a single finger 112 on either the medial side or the lateral side. The single medial or lateral side finger 112 may partly, substantially or fully wrap over to the other side (e.g., lateral or medial) of the article of footwear 100. Furthermore, the specific placement, dimensions and/or angles of the fingers 112 may differ from what is shown without departing from the spirit or scope of the invention.

The molded fingers 112 of the upper 104*a* increase airflow to the foot and allow for breathability and dissipation of water, as well as exceptional fit. The fingers 112 are preferably flexible enough to work independently, adjusting to the contours of the wearer's foot. This adaptability allows the shoe to fit a large subject population having varying foot geometries. The fingers 112 enable fit adjustment, with an emphasis on foot instep adjustment as well as midfoot and forefoot width adjustment. The geometry of the upper 104*a* allows for greater contour to the foot than in conventional footwear. The fit of articles of footwear of the present invention can accommodate variances in forefoot height and girth expected within the general population while providing a secure and comfortable fit for each wearer. Furthermore, the fingers 112 are able to accommodate variations among the left and right feet of the wearer. As seen in FIG. 1(*b*), the fingers 112, the heel support 114 and the midsole 104*b* may each include lacing channels or paths 116 adapted to receive a lace therein. FIGS. 1(*c*)-(*d*) illustrate side and top views, respectively, of the assembled article of footwear 100 including lace 118.

The lacing system in accordance with the present invention provides the lace 118 as a one piece lace preferably positioned about the foot that is adjustable by the wearer to optimize in-shoe security of his or her foot. The lace 118 is wrapped around the housing 104 of the article of footwear 100 in a spiral pattern, such as a circumferential, helical or coiled pattern. Preferably, the lace 118 is wound in the spiral-type pattern, e.g., the circumferential, helical or coiled pattern so that it envelops, surrounds or otherwise engages the wearer's foot in a manner which secures the article of footwear 100 to the foot for added support and security. More preferably, the lace 118 is wound so that it does not cross over itself as in a conventional crisscross lacing pattern. Most preferably, only a single lace 118 is employed in most cases, although as will be described below, some styles of footwear may utilize more than one lace 118.

The channels 116 allow for security of the lace 118 in the footwear 100 as well as allow movement of the lace 118 during adjustment. As noted above, the lacing system is preferably incorporated as part of the housing 104 through a series of the lacing channels 116 that may be molded into the housing 104. As can be seen, the channels 116 are substantially different from conventional eyelets. The lacing channels 116 along the fingers 112 and/or the heel support 114 may be open so that the lace can be seen, or may be partly or completely enclosed. Any or all of the channels 116 may run along or be disposed within the outside and/or inside surfaces of the upper 104*a*, preferably on the fingers 112. The channels 116 can either be integrally molded into the housing 104 during the molding operation or can be added to the housing 104 as a separate component. Additionally, channels may be hand punched into areas of the housing where molding is limited or problematic. It is desirable for the lace 118 to be received throughout the article of footwear 100 with low friction and with low abrasion on the lace 118. Thus, it is desirable to make the channels 116 as friction free as possible, for example by making the channels smooth and/or coating the interior surfaces with a low friction material such as silicone or a polymer resin such as polytetrafluroethylene ("PTFE"). Additionally, separate low-friction tube structures may be inserted into the molded lace channels to reduce friction and protect the foam and lace 118 from abrasion. The low friction channels 116, low friction lace 118, or both, facilitate sliding of the lace 118 and reduce energy to secure the lace 118 and the article of footwear 100 about the wearer's foot.

The wraparound lace 118 may be anchored at one or more points along the article of footwear 100. The anchor points may be located in a variety of positions along the article of footwear 100, as will be illustrated in the numerous embodiments of the present invention. A critical benefit of the anchor points is that they allow for the lace length and/or lace tightness to be adjusted for individual use and overall tension adjustment at different segments of the foot. FIG. 1(*a*) includes arrows around the fingers 112 and the heel support 114 showing the direction in which the lace 118 may be pulled to tighten the article of footwear 100 around the wearer's foot.

FIG. 2(*a*) illustrates a view of the bottom of the midsole 104*b* showing the lacing channels 116 therein. The stiffening member 108, may be disposed over or under the midsole 104*b*, is shown in outline form with a dotted line. The bottom view also illustrates a recess 120 at an end of one of the lacing channels 116 adjacent to the lateral metatarsal or toe region of the midsole 104*b*. In a preferred embodiment, a first end of the lace 118 is knotted and bonded to the recess 120, thereby anchoring or otherwise securing the first end of the lace 118 to the article of footwear 100 between the midsole 104*b* and the outsole 102.

FIG. 2(*b*) illustrates a view of the top surface of the outsole 102 which mates with the bottom surface of the midsole 104*b*. As indicated above, the top surface of the outsole 102 may be bonded or otherwise affixed to the bottom surface of the midsole 104*b*. If adhesive were applied along the entire top surface of the outsole 102, then the lace 118 would bond to the outsole 102 and would not be able to adjust by moving within the lacing channels 116. However, adjustment of the lace 118 is very important for fit and comfort of the article of footwear 100. In order to overcome this problem, the top surface of the outsole 102 preferably includes markings 122. The markings align with the lacing channels 116 on the bottom of the midsole 104*b*. The markings 122 act as a guide to workers during the manufacturing process. The guide instructs the workers where not to apply adhesive to the outsole 102. Therefore, the lace 118 is free to move within the lacing channels 116. The markings 122 may be molded into the outsole 102, or may comprise some other type of indicator, such as paint or texture, which allows the worker to know where to omit application of the adhesive. It is also possible to provide channels in the outsole to complement, supplement or replace the lacing channels 116 and/or the recess 120 on the midsole 104*b*. The channels may be molded into the top surface of the outsole at positions matching the channels 116 molded into the midsole.

FIG. 2(*c*) illustrates a partial see-through top-down view of the article of footwear 100, which shows the perimeters of the footbed 106 and the stiffening member 108. FIG. 2(*d*) illustrates a sectional view of the outsole 102, midsole 104*b*, and footbed 106 along the 2A-2A line of FIG. 2(*c*) showing that the optional stiffening member 108 may be disposed between the midsole 104*b* and the outsole 102. The lacing channels 116 are also shown in the midsole 104*b*. However, as noted above, such channels could also or alternatively be included in the outsole 102. FIG. 2(*e*) illustrates another sectional view along the 2A-2A line of FIG. 2(*c*), illustrating the inside lateral portion of the housing 104 of the article of footwear 100. While some details are omitted for clarity, such as the lacing channels 116 on the underside of the midsole 104*b*, portions of the lacing channels 116 are shown on the inside of the fingers 112.

Returning to FIG. 1(*a*), it can be seen that the lacing system may also include a lace end keeper or end cap 124, a lace pull 126, and/or a lace locking mechanism 128. In the present embodiment, the second end of the lace 118 is secured or anchored by the lace end keeper 124. The lace end keeper 124 preferably comprises a plug or cap which fits into a receptacle in one of the fingers 112. As shown, the lace end keeper 124 is positioned on a selected finger 112 in the lateral forefoot region near the ankle. FIG. 2(*f*) illustrates a cross-sectional view of cavity or receptacle 130 along the 1A-1A line of FIG. 1(*b*). The lace end keeper 124 is desirably removably insertable into the receptacle 130, permitting access to the second end of the lace 118 held in the receptacle 130. This allows for individual fit adjustment for the wearer's foot. It is also preferentially beneficial at the initial fitting of the footwear to a foot so as to maximize comfort and for support.

In a preferred embodiment, lace tension adjustment can be made by the wearer as follows. The lace end keeper 124 in, for example, the lateral forefoot region, forward of the ankle, can be opened by wearer. The end of the lace 118 can be removed from the receptacle 130 and cut to appropriate length. Then the end of the lace 118 is placed back into the receptacle 130 and the lace end keeper 124 is put back in place by the wearer to lock in the lace 118. The lace end may be burned and/or knotted for security and snug fit within the receptacle 130. Of course, it is possible to utilize lace keepers at both ends of the lace 118 and/or at any intermediate point(s) along the lace 118, as will be described in more detail below. Multiple lace keepers enable the user to adjust for different tension in different segments of the article of footwear 100. For example, the tension in the toe region of the article of footwear 100 may be different from the tension in the instep area or around the ankle. This accommodates foot variability and non-standard conformations resulting in enhanced support and/or comfort to the wearer.

The lace end keeper 124 and the receptacle 130 may have any number of configurations that can allow for an adjustable and secure receipt of the lace end. For example, the lace end keeper 124 may incorporate the use of a needle or pronged end to pin the lace end within the receptacle 130 when placing the cap back on. Alternatively, it is possible to wind the lace 118 about the lace end keeper 124 to adjust its fit. The unique wrap around, adjustable, lacing system with two anchor points, one at the recess 120 and the other at the connection between the lace end keeper 124 and the receptacle 130, provide a secure fit and even pressure distribution across the foot. It is desirable to have low friction on the lace 118 to keep pressure distribution even and to prevent abrasion or fraying of the lace 118.

Figure 3A:
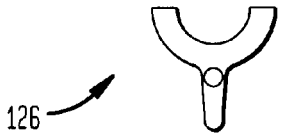
FIGS. 3(*a*)-(*c*) illustrate a lace keeper for use in accordance with aspects of the present invention.
Figure 3B:
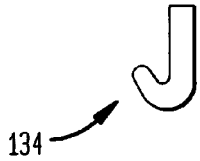
Figure 3C:
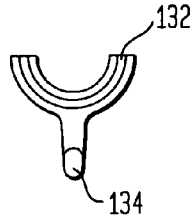
Figure 4C:
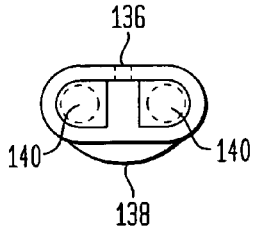
FIGS. 4(*a*)-(*k*) illustrate views of a locking mechanism for use in accordance with the present invention.
Figure 4B:
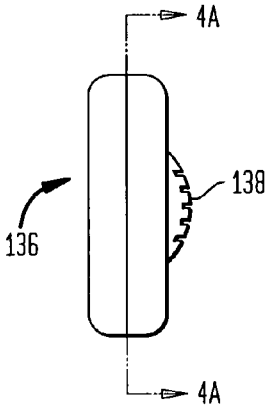
Figure 4A:
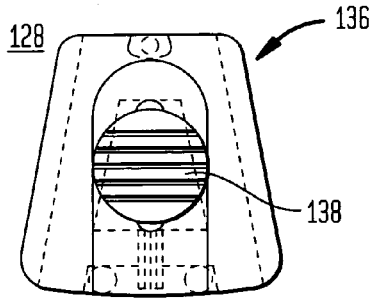
Figure 4E:
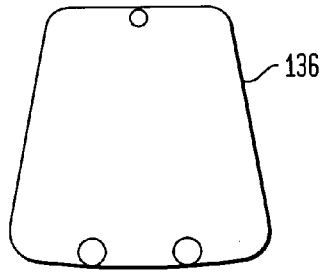
Figure 4F:
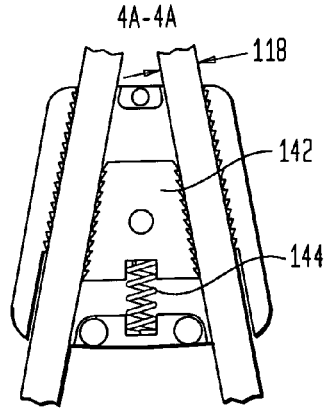
Figure 4D:
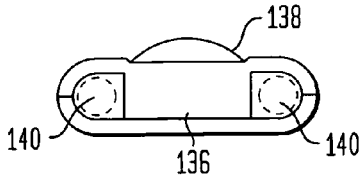
Figure 4G:
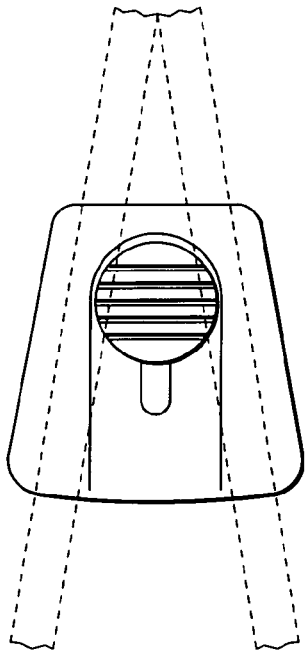
Figure 4J:
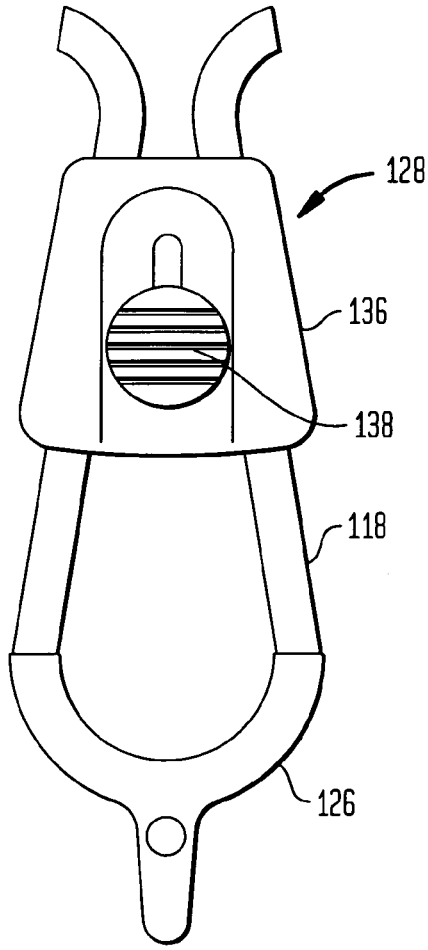
Figure 4H:
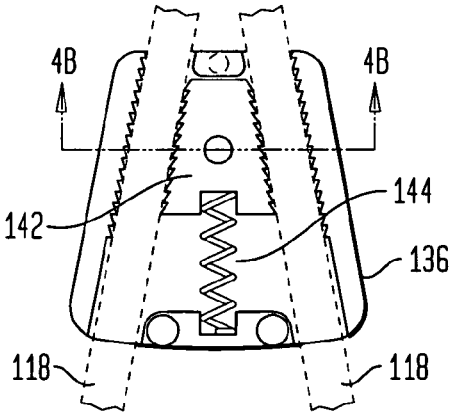
Figure 4K:
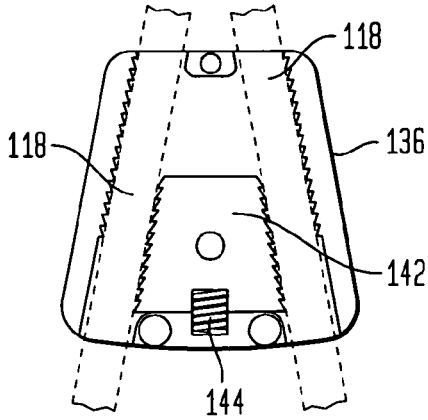
Figure 4I:
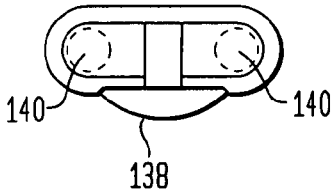
Figure 5A:
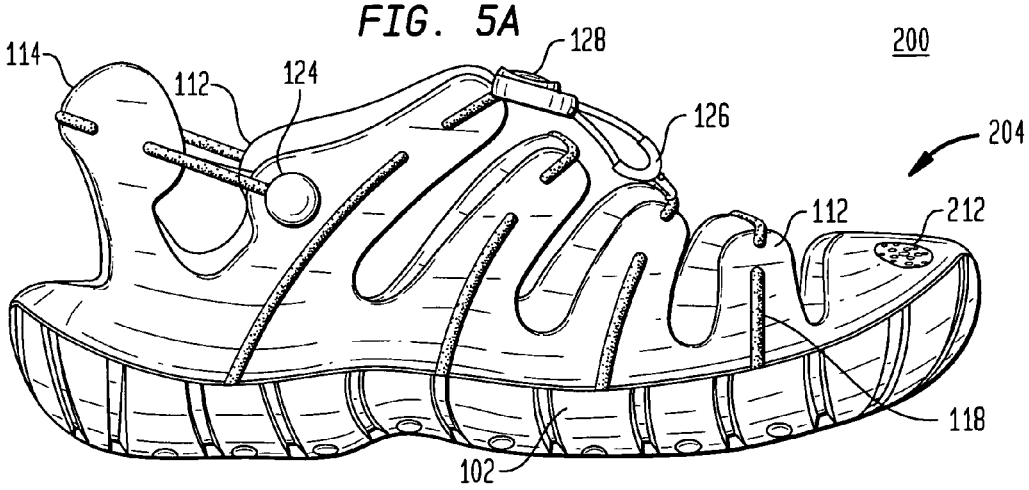
FIGS. 5(*a*)-(*d*) illustrate an article of footwear having an alternative sandal configuration in accordance with aspects of the present invention.
Figure 5B:
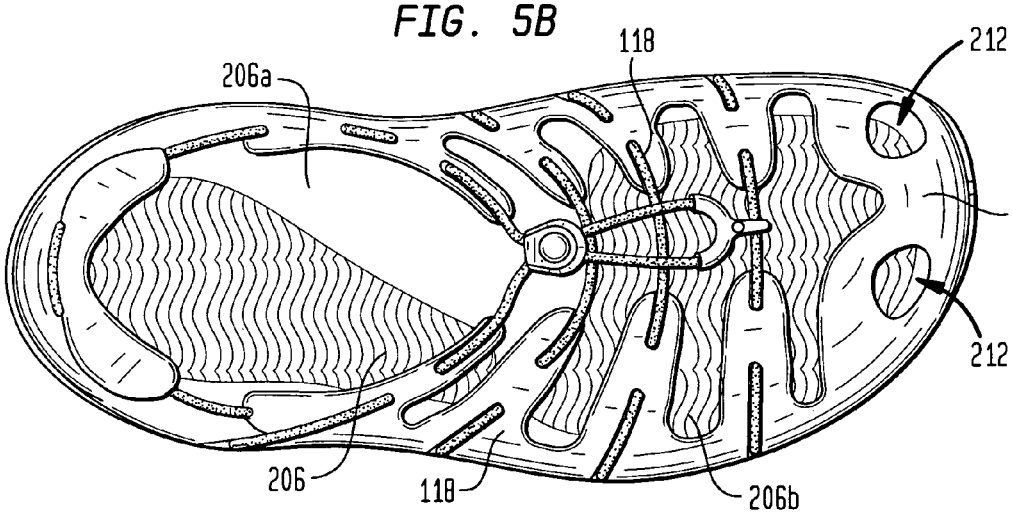
Figure 5C:
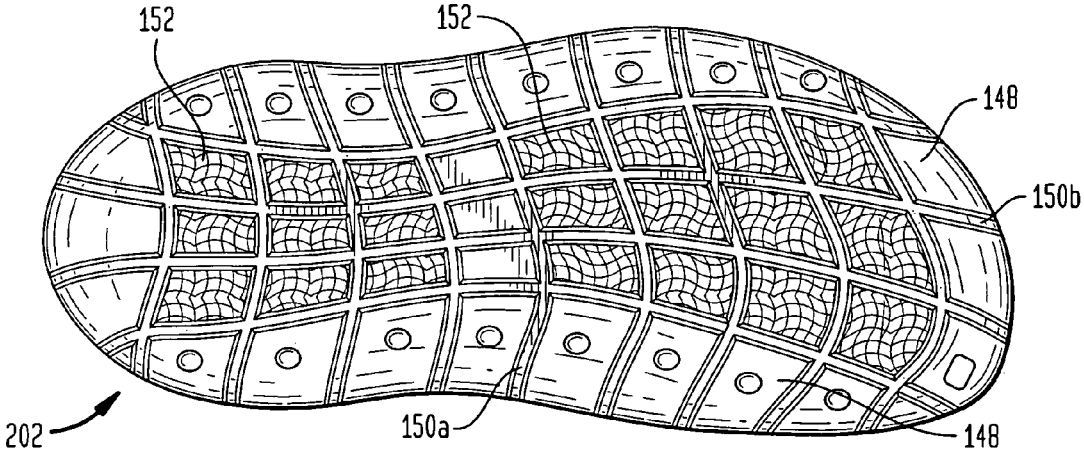
Figure 5D:
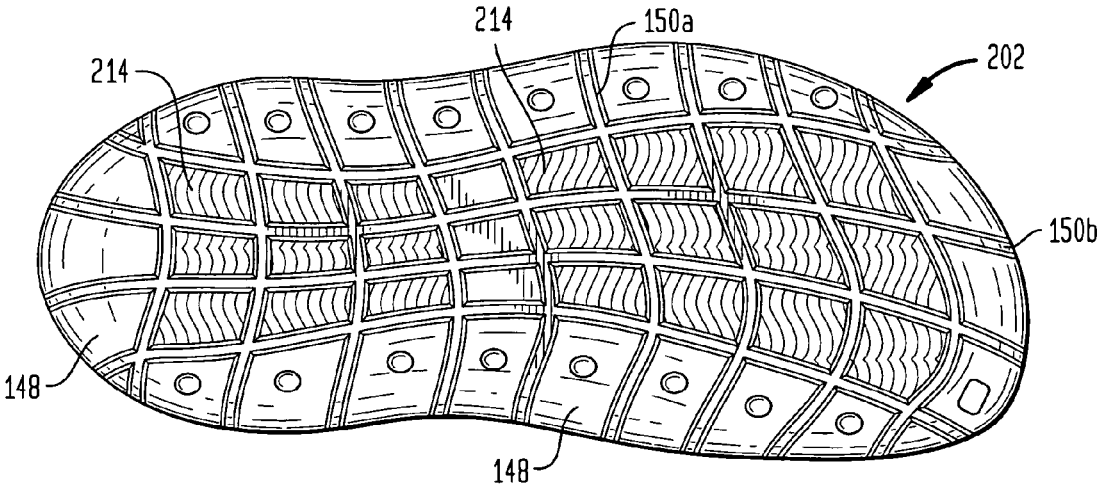
Figure 6A:
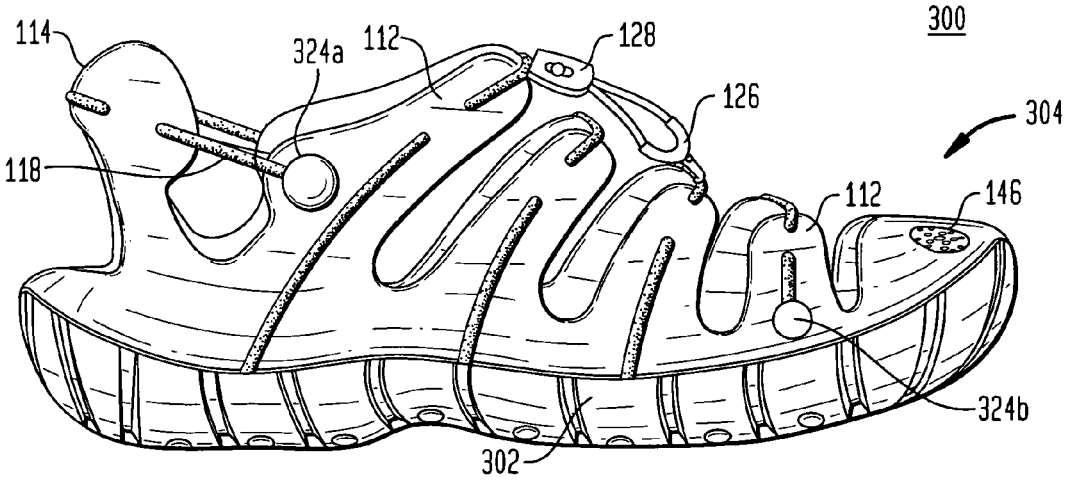
FIGS. 6(*a*)-(*f*) illustrate an article of footwear having another sandal configuration in accordance with aspects of the present invention.
Figure 6B:
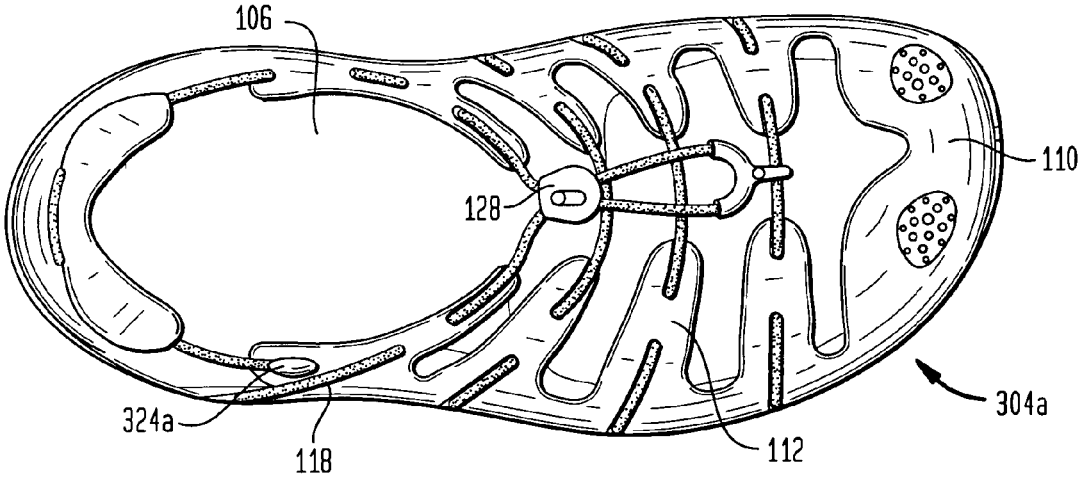
Figure 6C:
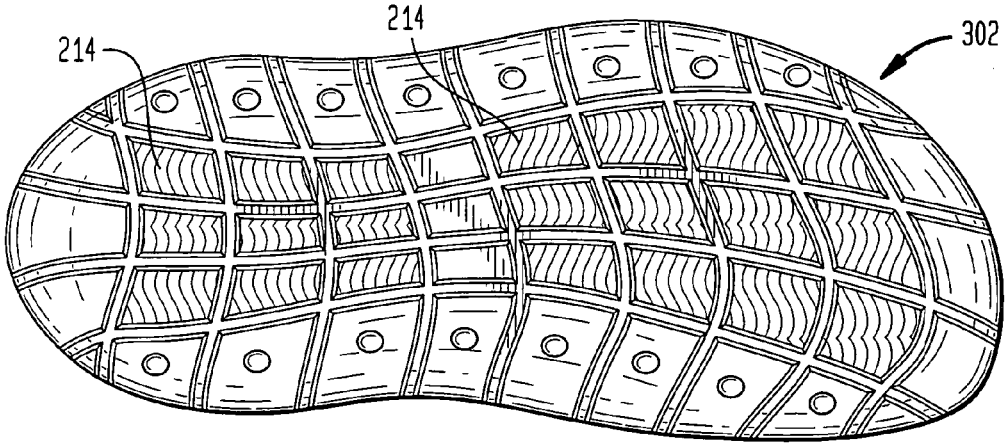
Figure 6D:
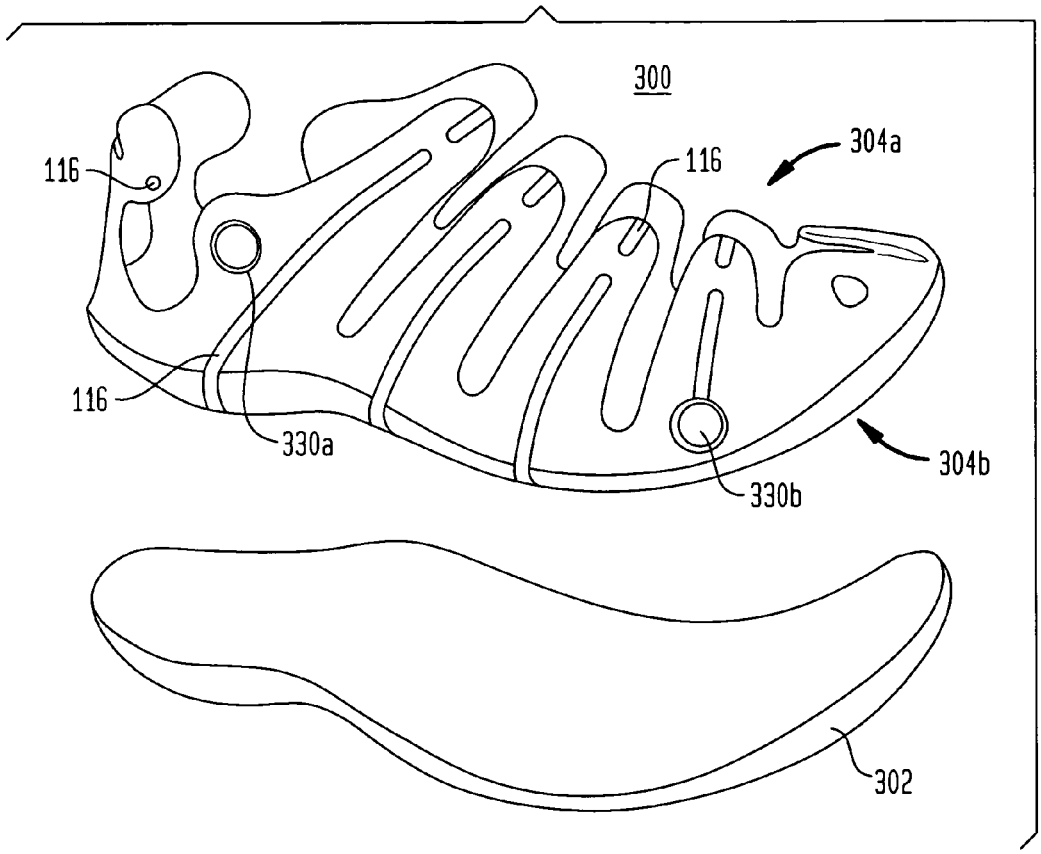
Figure 6E:
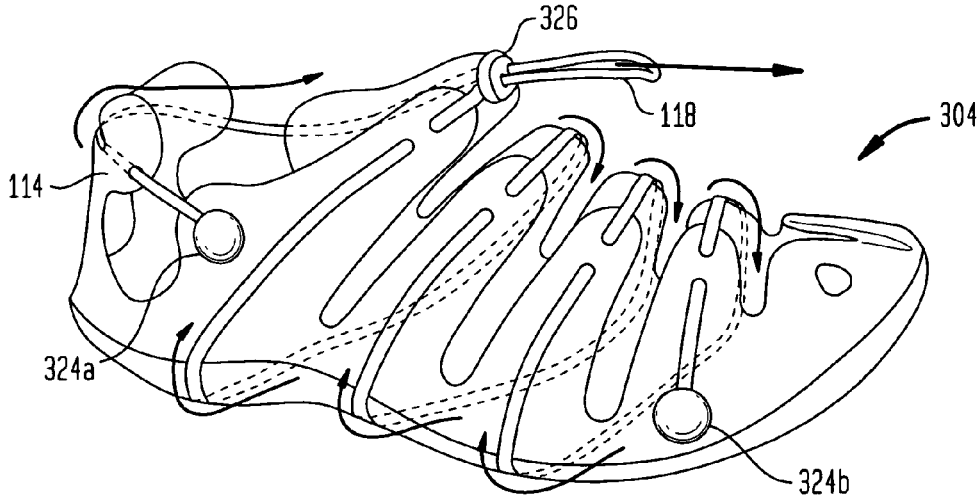
Figure 6F:
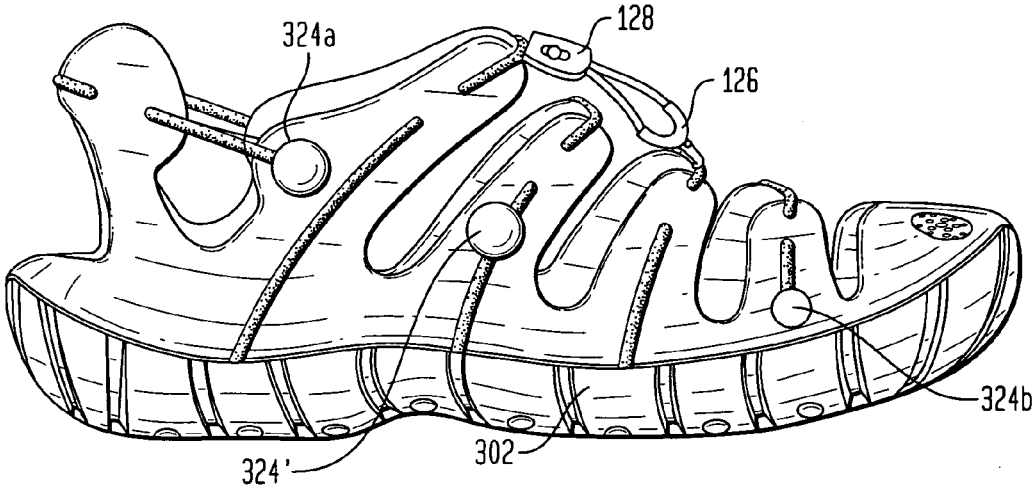

As mentioned above, the lacing system may also include one or both of the lace pull 126 and the lace locking mechanism 128. FIGS. 3(*a*)-(*c*) illustrate the lace pull 126. As shown in the front and rear views of FIGS. 3(*a*) and 3(*c*), respectively, the lace pull 126 generally has a "Y" shape. The rear side of the lace pull 126 may include a pathway 132 adapted to receive a portion of the lace 118 therein. As seen in the side view of FIG. 3(*b*), the lace pull 126 may include a storage hook or other connection member 134 for attaching the lace pull 126 to another portion of the lace 118. The storage hook 134 also keeps the lace 118 from becoming an annoyance or tripping hazard during use of the article of footwear 100.

FIGS. 4(*a*)-(*k*) illustrate the lace locking mechanism 128 in detail. As seen in the front and side views of FIGS. 4(*a*) and 4(*b*), respectively, the lace locking mechanism 128 includes a housing 136 and an adjuster 138 thereon. As seen in the respective top and bottom views of FIGS. 4(*c*) and 4(*d*), a pair of pathways 140 extend through the housing 136. The pathways are sized to allow the lace 118 to pass through. FIG. 4(*e*) illustrates the rear view of the lace locking mechanism 128.

FIG. 4(*f*) is a cutaway view along the 4A-4A line of FIG. 4(*b*) showing the interior of the housing 136. As seen in this view, the lace 118 is threaded through the pathways 140. A locking unit comprising a wedge 142 and a spring 144 are mechanically coupled to the adjuster 138, and permit or prevent adjustment of the lace 118 depending upon the position of the adjuster 138. FIG. 4(*g*) illustrates the lace 118 in the "locked" position with the adjuster 138 positioned near the top or first end of the housing 136. FIG. 4(*h*) shows the placement of the wedge 142 and the spring 144, with the wedge 142 being disposed near the top or first end of the housing 136. The surfaces of the pathways 140 and/or the surfaces of the wedge 142 adjacent the lace 118 may have ridges, protrusions or other structures to restrict the movement of the lace 118. FIG. 4(*i*) is a sectional view along the 4B-4B line of FIG. 4(*h*) showing placement of the wedge 142 in the locked position.

FIG. 4(*j*) illustrates the lace locking mechanism 128 in the "unlocked" position with the adjuster 138 positioned near the bottom or second end of the housing 136. FIG. 4(*i*)

shows the placement of the wedge 142 and the spring 144, with the wedge 142 being disposed near the bottom or second end of the housing 136. The ridged or friction creating surfaces of the wedge 142 are not in contact with the lace 118. Thus, the lace 118 is free to move within the pathways 140. In a preferred example, the lace locking mechanism 128 is positioned at or near the top of the forefoot. However, the lace locking mechanism 128 can be positioned anywhere else along the upper 104*a*. Thus, it can be seen that the lace locking mechanism 128 allows for the securing and loosening of the lacing system and, in turn, the upper 104*a* to the foot of the wearer. Of course, any number of lace locking mechanisms 128 can be used with the article of footwear 100.

The lace pull 126 and the lace locking mechanism 128 may be used separately or together to provide enhanced security and a snug fit. When used in combination, the lace pull 126 may be added onto the lace 118 and positioned on the lace 118 after it exits one of the pathways 140 of the lace locking mechanism 128 but before reentering the other pathway 140 on the opposite side of the lace locking mechanism 128, as depicted in FIG. 1(*a*). This placement of the lace pull 126 would allow the lace 118 to be kept close and secure to top of the housing 104. In turn, this prevents the lace 118 from catching on objects. Furthermore, it is a common issue with footwear to have excess lace after adjusting the tension of the lace 118. Any number of lace pulls 126 or other form of lace hooks can be used to help store and secure the excess lace and prevent the lace 118 from catching on objects.

Returning to FIG. 1(*a*), another aspect of the present invention is a ventilation area at the top of the toe cap 110. As discussed above, the toe cap 110 provides protection for the front of the foot/toe area (e.g., metatarsals and phalanges) by protecting this area from direct contact with external objects. By incorporating areas on the top of the toe region that have holes or areas for ventilation, air and moisture can freely travel in and out, but debris is kept out of shoe.

In a preferred embodiment, ventilation and protection are achieved through openings or holes incorporated into the toe cover 110. Desirably, the ventilation holes have screens or "debris shields" fitted into/over the openings to maintain ventilation but keep debris out of the toe region of the shoe. It can be seen in FIG. 1(*a*) that openings of the toe cover 110 may include one or more debris shields 146. The ventilation holes in the debris shields 146 may be of various shapes and/or sizes. The debris shields 146 may be integrally formed as part of the toe cover 110 or may be added after the injection molding process. In one example, the debris shields comprise fine metal screens.

In addition to the secure lacing system and the ventilation in the toe cover 110, another aspect of the present invention provides optimized traction on the bottom of the article of footwear 100 for wet or smooth surfaces. This is preferably achieved through the use of both molded-in siping as well as the addition of siping cut in the opposite direction in the quad cut configuration. FIG. 1(*e*) illustrates a bottom view showing the portion of the outsole 102 which contacts the ground. As seen in this view, the outsole 102 may include one or more sections, quadrants, or regions 148. The regions 148 may be separated by lines or spacers 150*a* running partly or completely from the medial side to the lateral side of the article of footwear 100, as well as by longitudinal lines or spacers 150*b* running partly or completely from the toe region to the heel region of the article of footwear 100. Each region 148 may include symbols, logos, size information, style data, source identifiers, designs such as circles or other geometric patterns, etc. Each region 148 may also include structural features such as siping 152 to improve traction on wet surfaces. The siping 152 may be, for example, in a "quad cut" configuration, as shown in FIG. 1(*e*), where the siping runs both from side to side and front to back, for instance in an undulating or wave-like pattern that forms traction reinforcing microquadrants in the outsole 102. The siping 152 may be confined within one or more of the regions 148, or may also be incorporated into the lines or spacers 150*a,b*. FIGS. 1(*f*) and 1(*g*) illustrate front and rear views, respectively, of the article of footwear 100, showing the lacing 118, the regions 148, the spacers 150*a,b*, and the siping 152.

The siped outsole 102 provides traction on wet surfaces through diversion of water from the bottom surface of the outsole 102. The duel siped quad cut area provides optimized surface area contact for the wearer, enhancing the traction of the rubber outsole 102. The quad cut configuration is ideally suited for wet and/or smooth surface contact. Optionally, the quad cut configuration can be incorporated into specific areas of the outsole 102, such as the forefoot and the heel, while using more traditional lugs and/or other siping configurations on the medial/lateral perimeters to optimize for multi-surface use.

FIGS. 5(*a*)-(*c*) illustrate side, top and bottom views, respectively, of an article of footwear 200 similar to the article of footwear 100 discussed above. As with the article of footwear 100, the article of footwear 200 has a sandal configuration with the wraparound lacing system, as seen in FIGS. 5(*a*) and 5(*b*). The quad cut siping within the regions 148 is shown in FIG. 5(*c*). The differences between the article of footwear 200 and the article of footwear 100 will now be described. In the article of footwear 200, the housing 204 comprises an integrally molded upper and midsole (not shown) as well as an integrally molded footbed 206, which is part of the unitary housing 204.

As shown in the top view of FIG. 5(*b*), the integrally molded footbed 206 comprises two regions 206*a* and 206*b*, although any number of regions 206*n* may be employed. In the illustrated example, the regions 206*a* and 206*b* have different texture. For instance, the region 206*a* may be substantially smooth, and the region 206*b* may be ridged, siped or otherwise textured. The regions of different texture may be created via a pattern or texture in the mold. Additionally, the texture pieces may be created separately and then co-molded into the larger mold. Using this technique, the regions can be made of a material different from the larger component. This allows for a material of greater resiliency to be placed in high impact and/or high wear areas such as under the heel and forefoot where high impact forces are realized during locomotion. Preferably, the regions 206*a* and 206*b* comprise CMEVA. More preferably, these two regions comprise bonded CMEVA that is on the order of 3 mm thick, for example between 2 mm and 4 mm thick. Another difference from the article of footwear 100 is that the toe cover 210 does not include a debris screen or shield. Instead, the toe cover 210 includes openings 212 for ventilation. An alternative to the quad cut siping of FIG. 5(*c*) is shown in FIG. 5(*d*). Here, transverse siping 214 running between the medial and lateral sides of the outsole 200 is created, for example, by cutting the outsole 202 after initially molding the outsole 202. The lateral siping can also be formed during the molding process.

FIGS. 6(*a*)-(*c*) illustrate side, top and bottom views, respectively, of an article of footwear 300 generally similar to the article of footwear 100 discussed above. As with the article of footwear 100, the article of footwear 300 preferably has a sandal configuration with the wraparound lacing system, as seen in FIGS. 6(*a*) and 6(*b*). The quad cut siping in the outsole 102 is shown in FIG. 6(*c*), and is preferably molded in the outsole 102. The main difference between the article of footwear 300 and the article of footwear 100 pertains to the lace end retention system, which will now be described.

As shown in FIG. 6(*a*), the lacing system of the article of footwear 300 preferably includes a pair of lace end keepers or end caps 324*a* and 324*b*, the lace pull 126, and the lace locking mechanism 128. In the present embodiment, the first and second ends of the lace 118 are secured or anchored by the lace end keepers 324*a* and 324*b*, respectively. As with the lace end keeper 124, the lace end keepers 324*a* and 324*b* preferably each comprise a plug or cap which fit into receptacles in the fingers 112. As shown, the lace end keeper 324*a* is positioned on a first selected finger 112 in the lateral metatarsal region near the toe cover 110, and the lace end keeper 324*b* is positioned on a second selected finger 112 in the lateral forefoot region near the ankle. One or both of the lace end keepers 324*a,b* may be placed on either the medial or the lateral side of the article of footwear 300. The lace end keepers 324*a* and 324*b* are desirably removably insertable into the receptacles on the fingers 112, permitting access to the ends of the lace 118 held therein. Alternatively, the lace end keepers 324*a,b* may be bonded into the receptacles, for instance by using an appropriate bonding agent such as water or solvent based cement.

FIG. 6(*d*) is an exploded view of the article of footwear 300, illustrating the integrally molded upper 304*a* and midsole 304*b* and the separate outsole 302. In this view, the lace 118 is omitted to show the channels 116 and the lace end keepers 324*a* and 324*b* are omitted to show respective cavities or receptacles 330*a* and 330*b*.

In a preferred embodiment, lace tension adjustment can be made by the wearer as follows. A first one of the lace end keepers 324*a* or 324*b* can be opened by wearer. The end of the lace 118 can be removed from the receptacle and cut to appropriate length. Then the end of the lace 118 is placed back into the receptacle and the lace end keeper 324*a* or 324*b* is put back in place by the wearer to lock in the lace 118. The lace end may be burned and/or knotted for security and snug fit within the receptacle. The same procedure can be repeated at the other one of the lace end keepers 324*b* or 324*a*. The adjustment may be a one-time adjustment which allows for customization of fit to an individual's foot. Daily or routine adjustment of the lace tension is preferably accomplished by pulling on the lace pull 126 and/or the lace locking mechanism 128. It is also possible to replace the lace 118, for example to change out a broken lace or to change the style, size, etc.

As with the lace end keeper 124 and the receptacle 130, the lace end keepers 324*a,b* and the associated receptacles in the upper of the article of footwear 300 may have any number of configurations that can allow for an adjustable and secure receipt of the lace end. For example, the lace end keepers 324*a* and/or 324*b* may incorporate the use of a needle or pronged end to pin the lace end within the receptacle when placing the cap back on. Alternatively, it is possible to wind the lace 118 about the lace end keeper 324*a* and/or 324*b* to adjust its fit. The unique wrap around, adjustable, lacing system with two anchor points, one at the lace end keeper 324*a* and the other at the lace end keeper 324*b* provide a secure fit and even pressure distribution across the foot. It is desirable to have low friction on the lace 118 to keep pressure distribution even and to prevent abrasion or fraying of the lace 118.

FIG. 6(*e*) illustrates a view of the integrally molded housing 304 with the lace 118, the lace end keepers 324*a* and 324*b*, and a modified lace pull 326. The arrows show how the lace 118 wraps around the housing 304 in the spiral configuration, e.g., a circumferential, helical or coiled pattern, and that it may be pulled and tightened using the lace pull 326. If the lace pull 326 is included, it may be slid forward or backward relative to the loop of the lace 118, thereby loosening or tightening the lace 118.

While only two lace end keepers 324*a* and 324*b* are shown, any number of lace keepers may be positioned along the housing 104 between the endpoints of the lace 118. For instance, as seen in FIG. 6(*f*), at least one mid-lace keeper 324' may be positioned along one of the fingers 112. The mid-lace keeper 324' provides for separate adjustment of the lace 118 aside from adjustment at the endpoints of the lace 118. The mid-lace keeper 324' allows the user to perform separate adjustments and thus varying amounts of lace tension across different areas or zones of the foot. For instance, many people apply low lace tension across the toe box and higher lace tension across the instep region to provide a secure fit across the instep region with a looser fit across the toes. A single lace 118 or multiple laces 118 may be employed across one or more of the zones. If multiple laces 118 are used, each lace 118 may include any number of lace keepers such as the lace end keepers 324*a,b* and/or the mid-lace keeper(s) 324'. Multi-zone adjustment permits the wearer to achieve a desired fit. The mid-lace keeper 324' may be used in place of or in combination with the lace pull 126 and the lace locking mechanism 128. The mid-lace keeper 324' can be adjusted in the same or a similar manner to the adjustment of the lace end keepers 324*a* and 324*b*. A pin, needle, cleat, etc. can be used to hold the lace 118 in place along with the mid-lace keeper 324', and then further adjustment may be made at one or both of the lace end keepers 324*a* and 324*b*. Alternatively, it is possible to wind or twist the lace 118 about the mid-lace keeper 324' to adjust its fit. The placement of the lace keeper(s) is not limited to any specific point on the housing 104; instead lace keepers such as the lace end keepers 324*a,b* and/or the mid-lace keeper(s) 324' may be positioned at any point or region of the upper 304*a* in which they can be coupled to or otherwise in communication with the lace 118.

Figure 7:
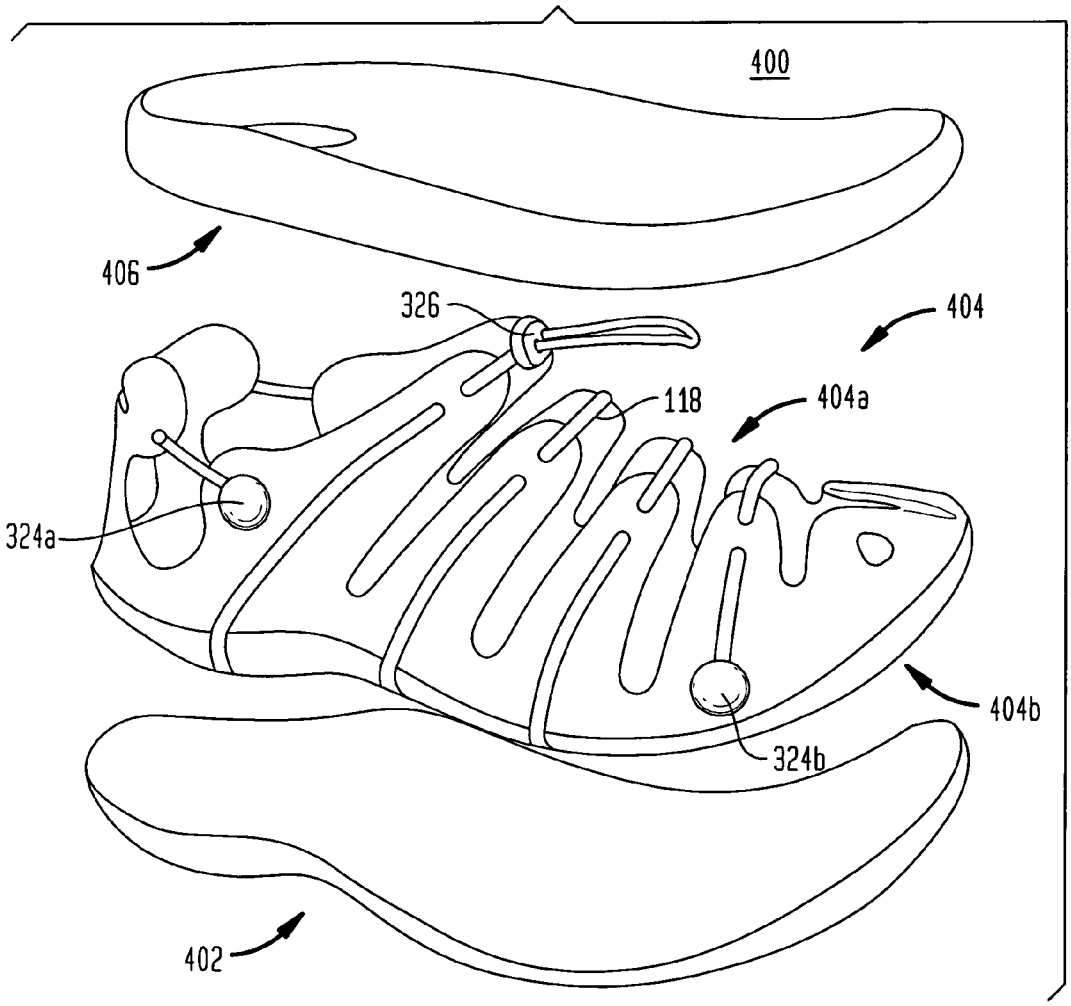
FIG. 7 illustrates an article of footwear having a further sandal configuration in accordance with aspects of the present invention.

FIG. 7 illustrates an exploded view of an article of footwear 400 generally similar to the article of footwear 300 discussed above. The article of footwear 400 preferably has a sandal configuration with the wraparound lacing system. In the embodiment of FIG. 7, the article of footwear 400 comprises an outsole 402, an integrally molded housing 404 including upper 404*a* and midsole 404*b*, and a footbed 406. The footbed 406 is preferably formed of foam rubber, but can be made with any suitable material or materials, such as EVA, PU, latex rubber, cork, leather, etc.

More preferably, the footbed 406 is a removable self customizing footbed. In this embodiment, the footbed 406 may be constructed of CMEVA with a top layer of moldable foam. The moldable foam may be a polyolefin foam such as the nitrogen expanded polyolefin foam marketed under the trademark PLASTAZOTE® from Zotefoams PLC, which allows the footbed to contour to the wearer's foot over time. Moldable foams enhance both comfort and security during wear. The use of a removable antimicrobial footbed cover can also be incorporated into the footbed 406. Antimicrobial properties incorporated into materials can reduce the growth of mold, bacteria, mildew and fungus often associated with warm, moist environments. This can be accomplished by the use of materials treated with an antimicrobial compound as is known in the art, or by the use of inherently antimicrobial material such as bamboo fiber. The removable footbed 406 allows for faster drying time and cleaning if necessary. Alternatively, the removable footbed 406 can easily be removed and washed separately from the article of footwear 400, if necessary.

Figure 8:
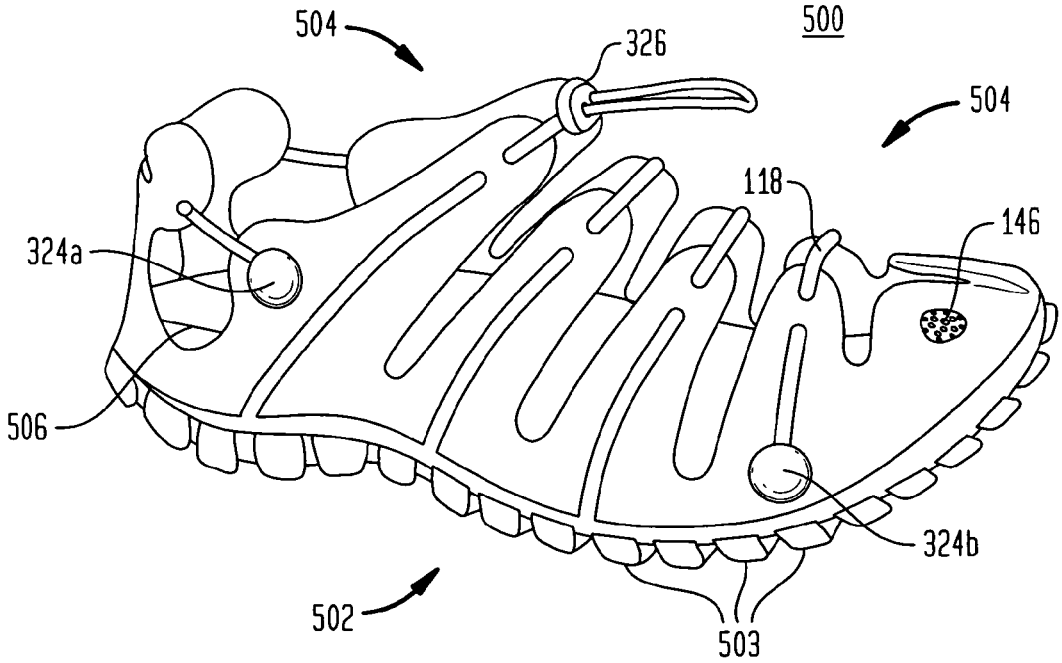
FIG. 8 illustrates an article of footwear in accordance with aspects of the present invention.
Figure 9A:
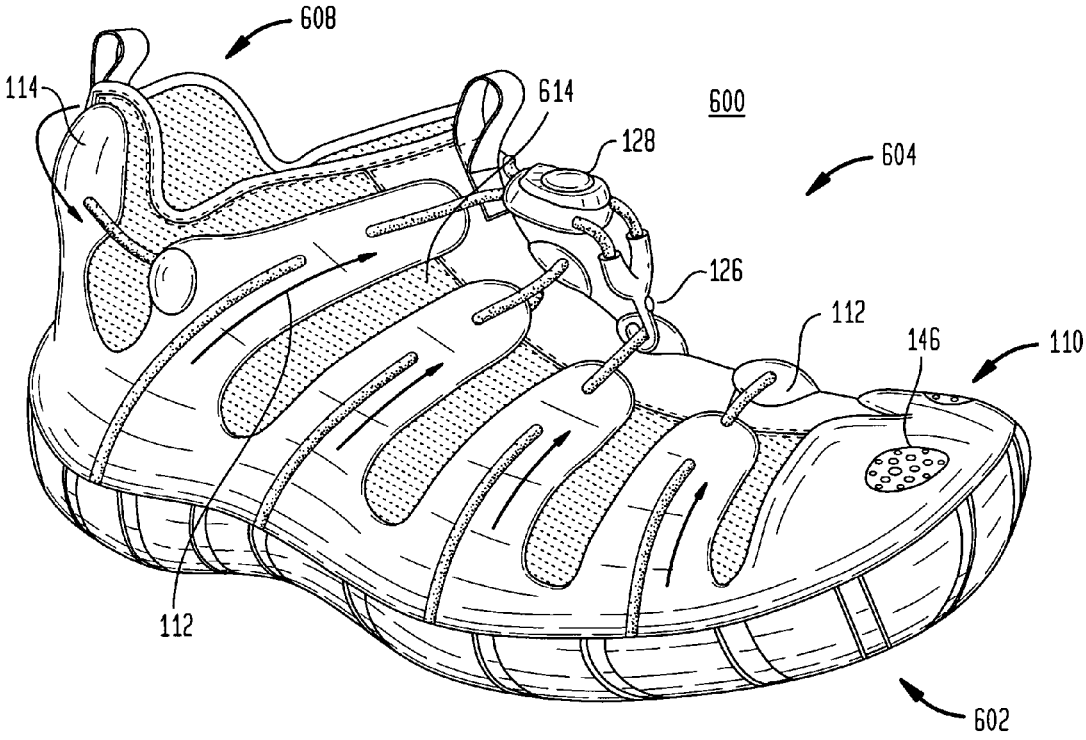
FIGS. 9(*a*)-(*h*) illustrate an article of footwear having a removable liner in accordance with aspects of the present invention.
Figure 9B:
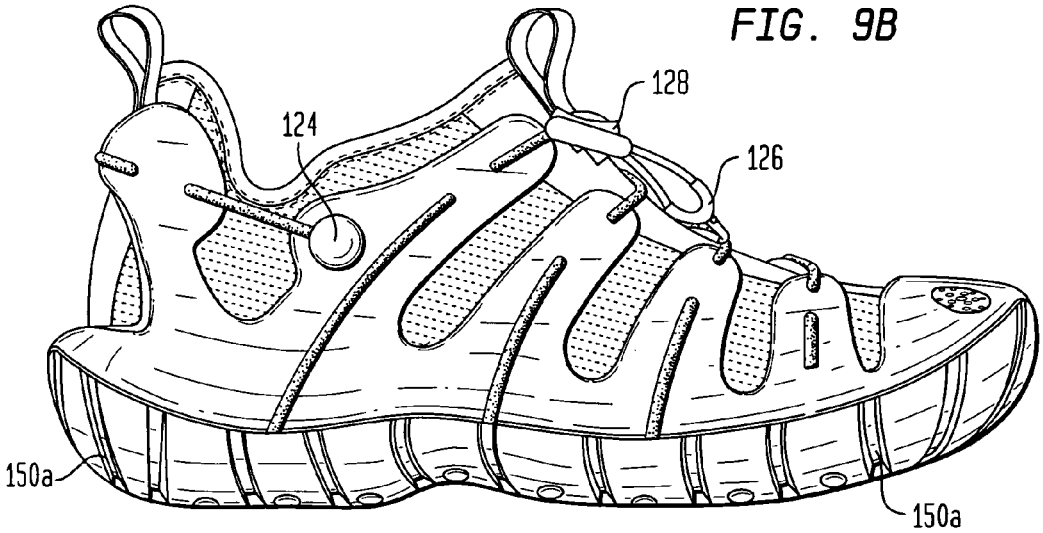
Figure 9C:
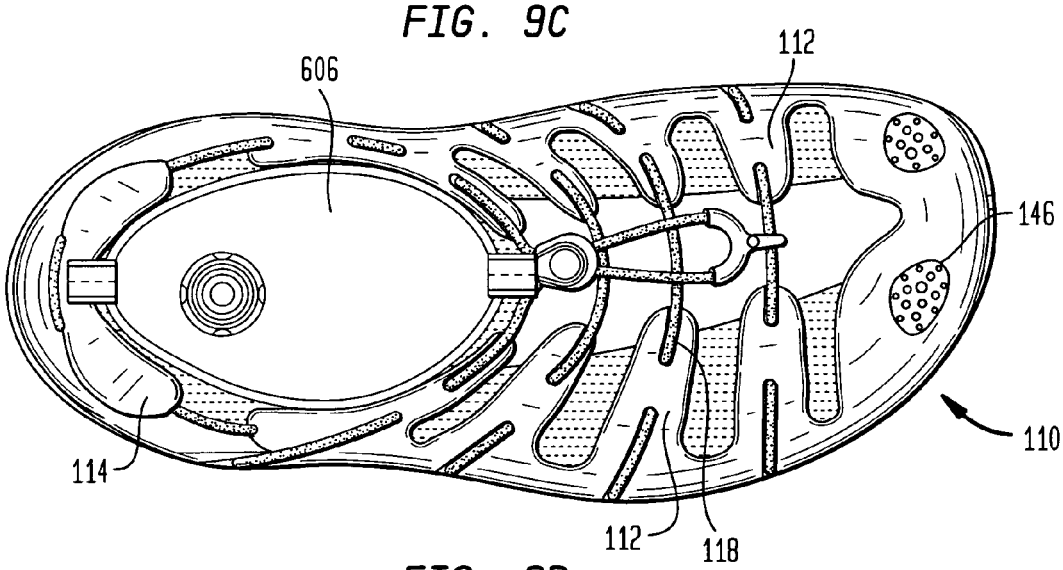
Figure 9D:
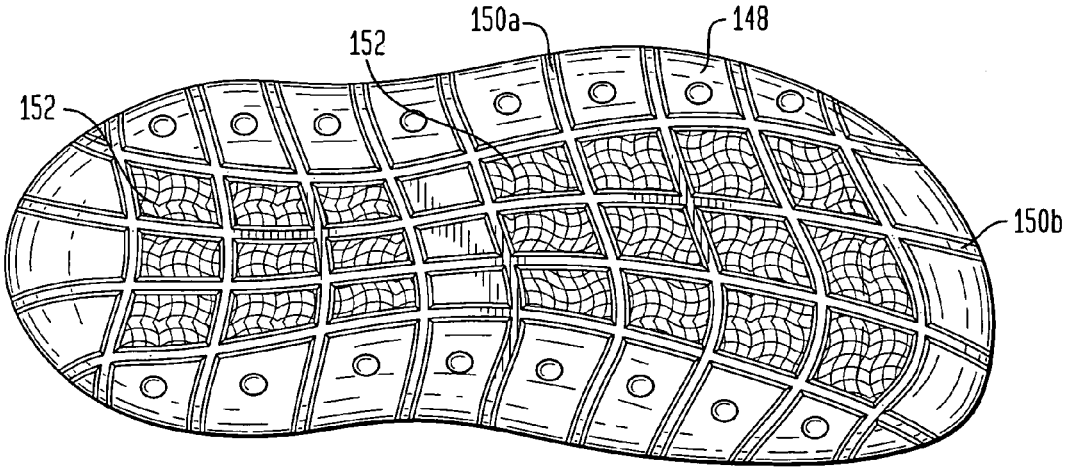
Figure 9E:
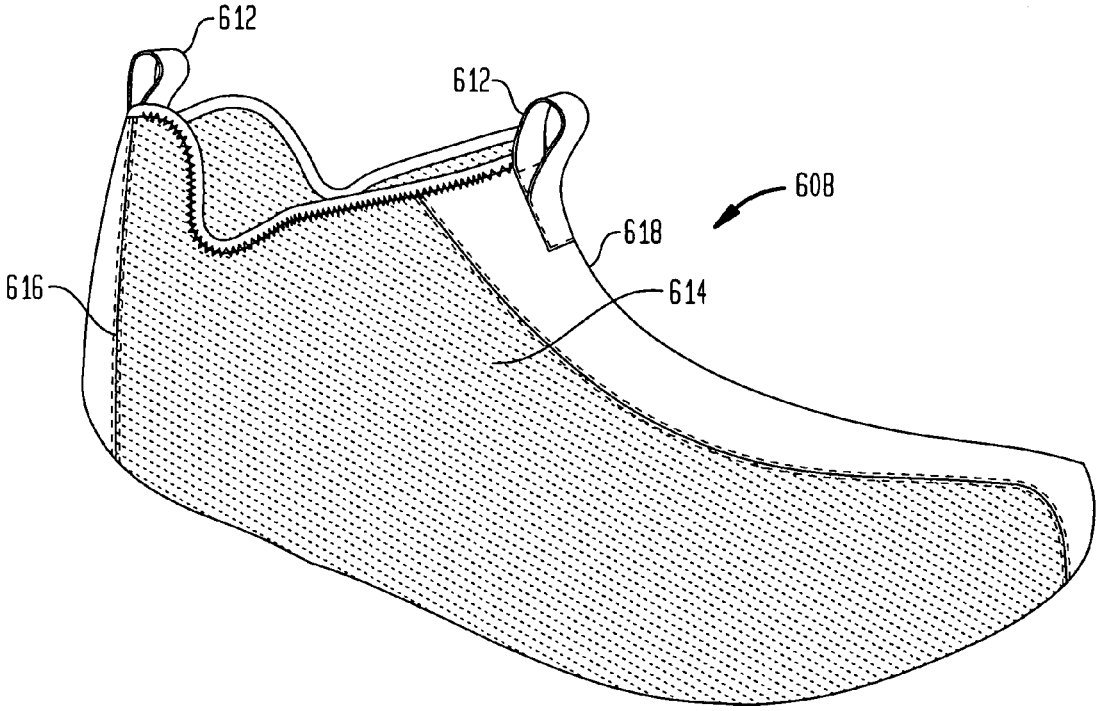
Figure 9F:
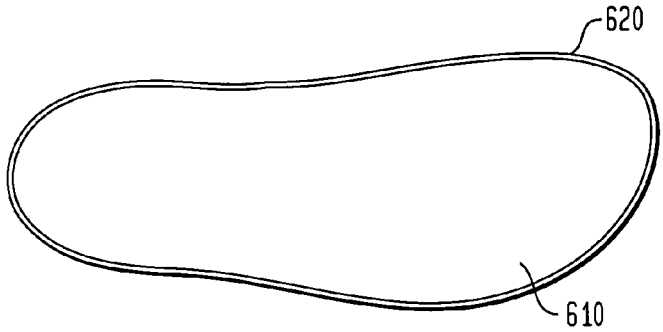
Figure 9G:
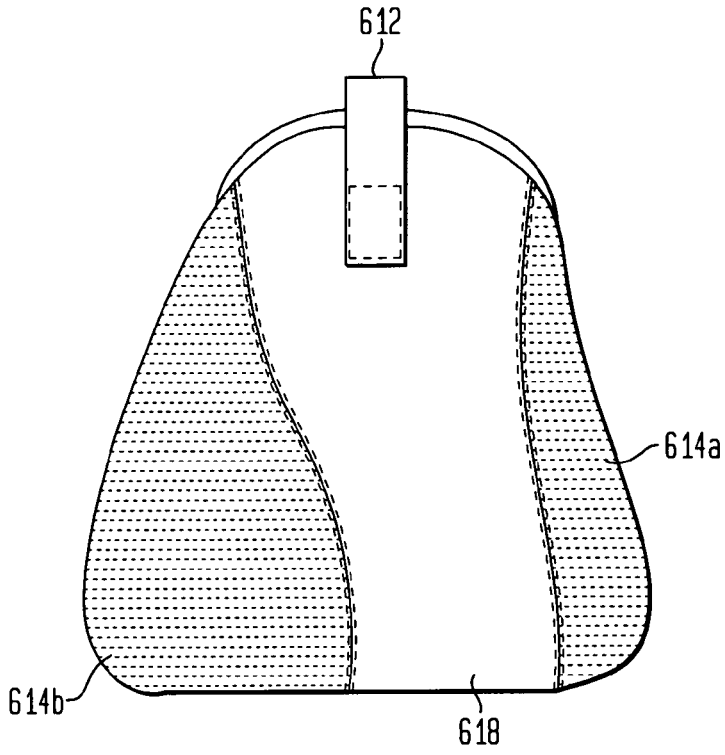
Figure 9H:
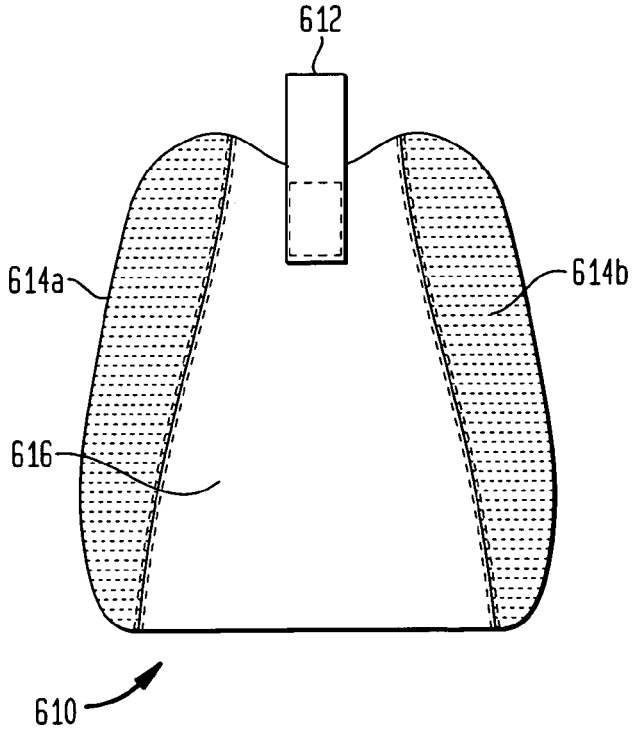
Figure 10A:
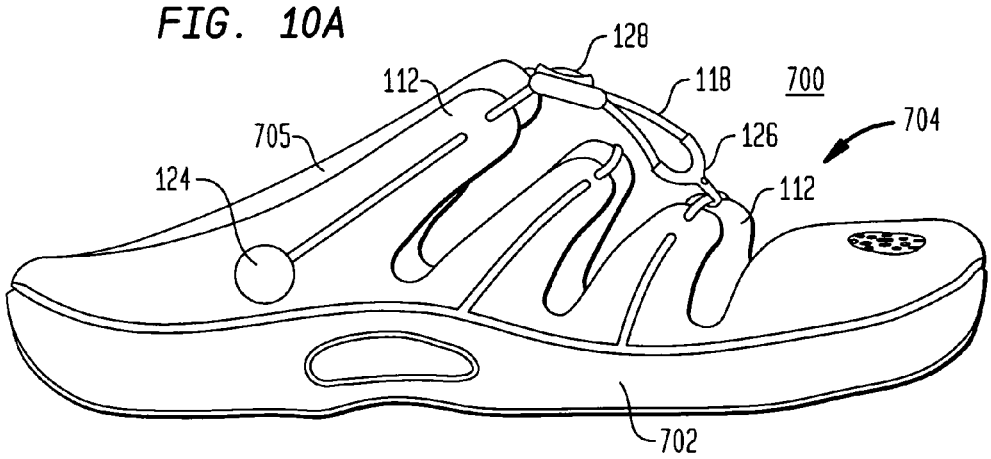
FIGS. 10(*a*)-(*d*) illustrate an article of footwear having a slide configuration in accordance with aspects of the present invention.
Figure 10B:
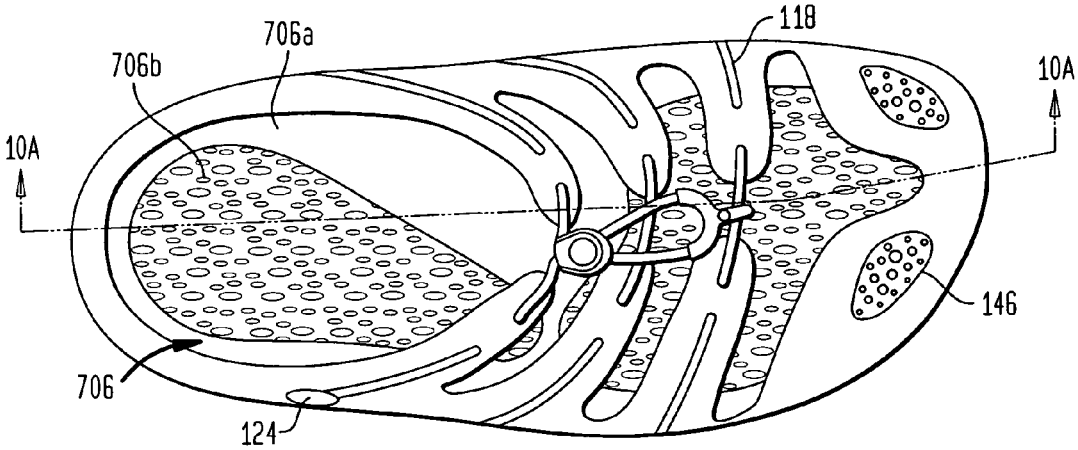
Figure 10C:
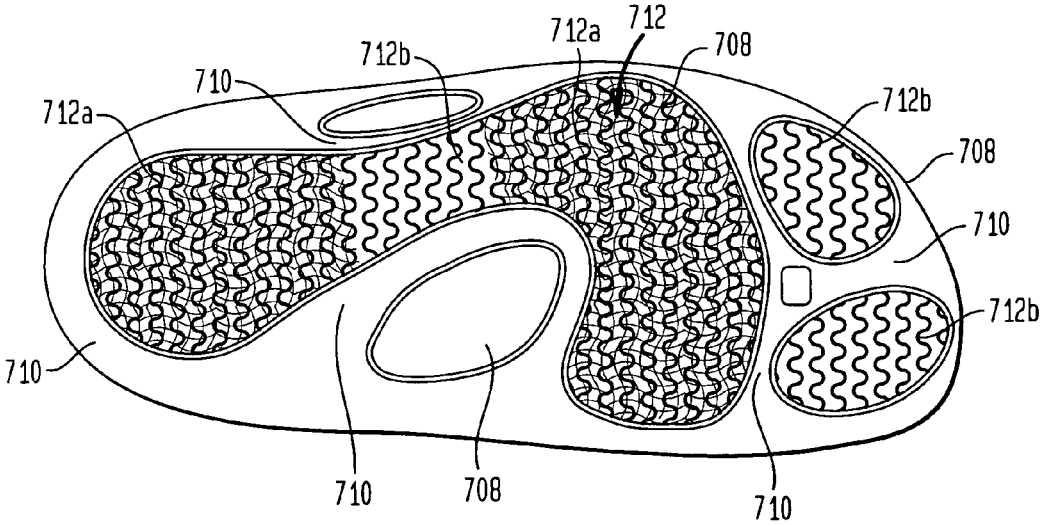
Figure 10D:
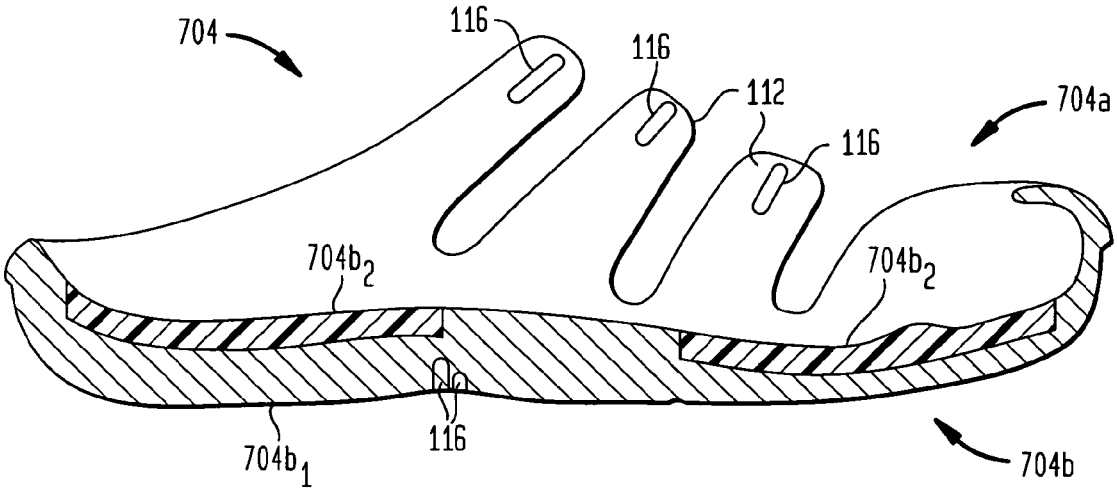
Figure 11A:
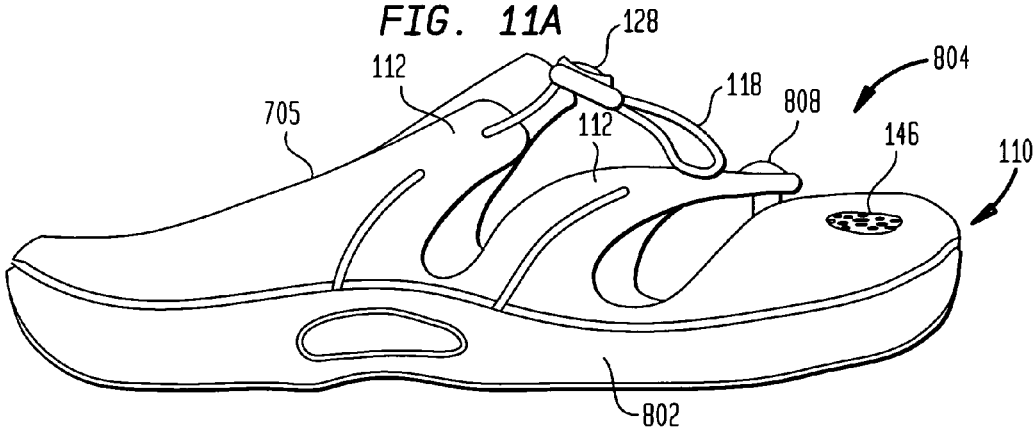
FIGS. 11(*a*)-(*g*) illustrate an article of footwear having a flip-flop or thong sandal configuration in accordance with aspects of the present invention.
Figure 11B:
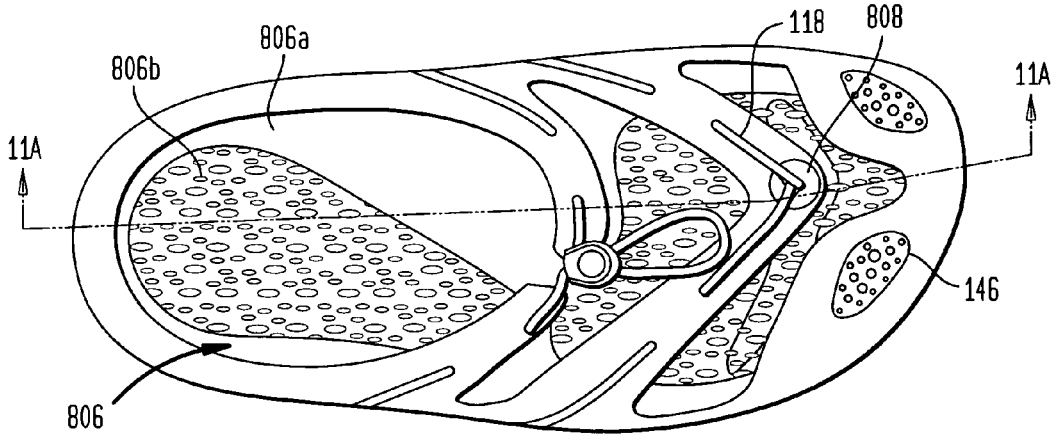
Figure 11C:
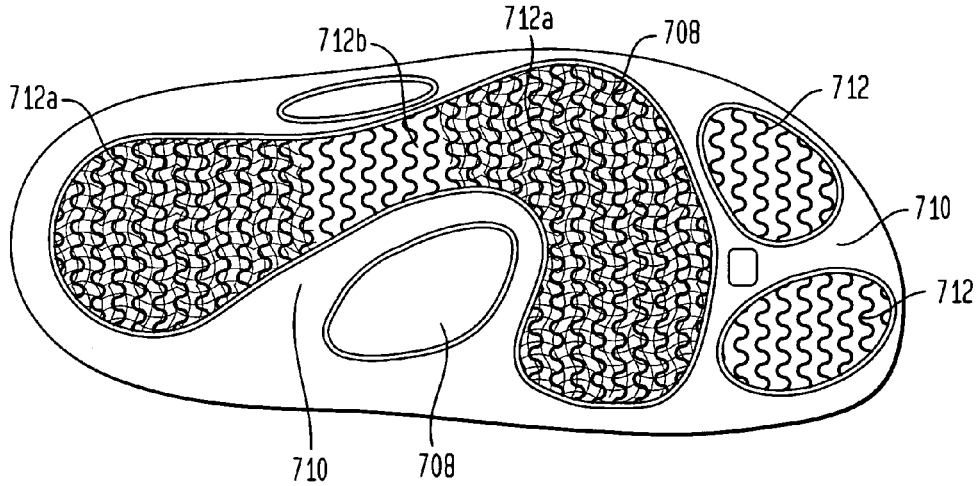
Figure 11D:
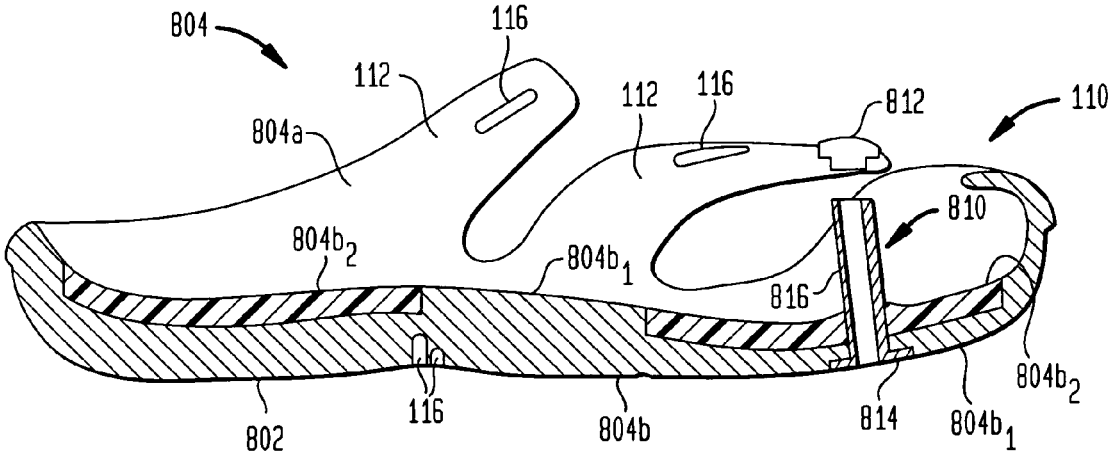
Figure 11E:
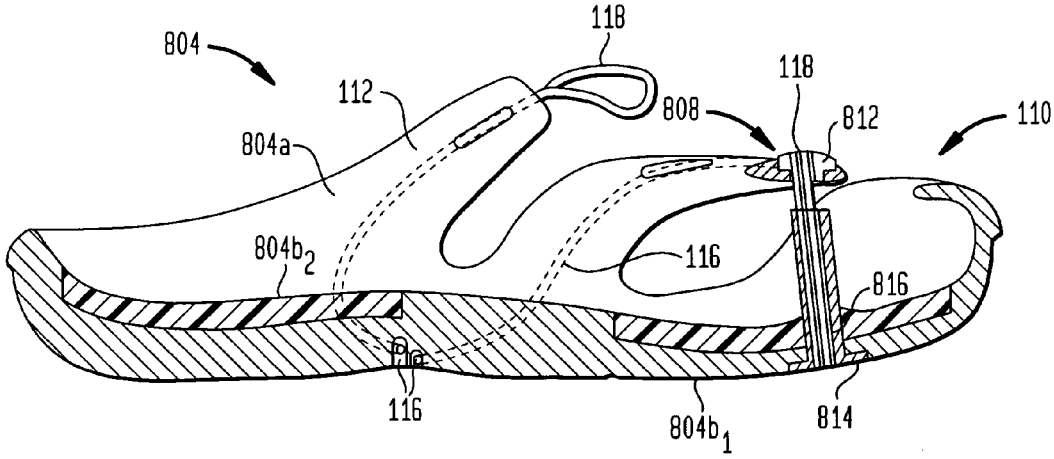
Figure 11F:
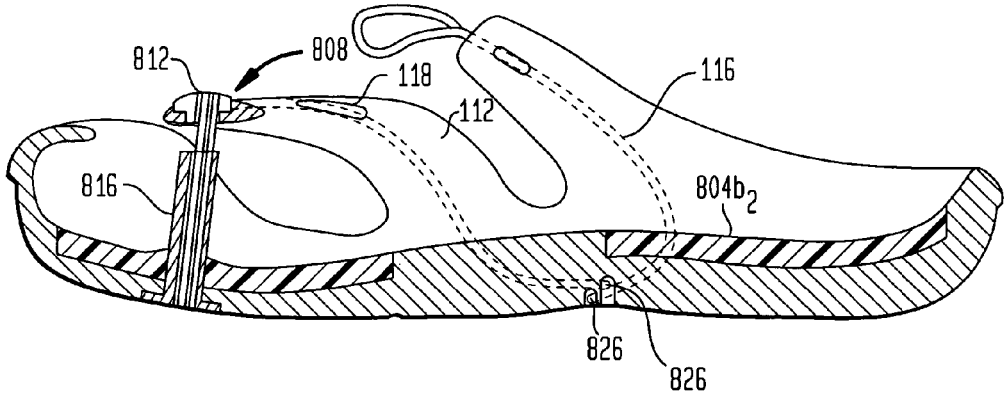
Figure 11G:
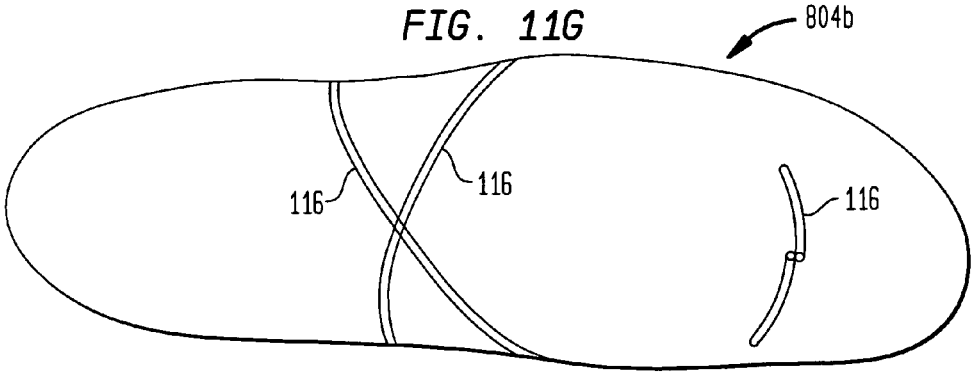
Figure 12A:
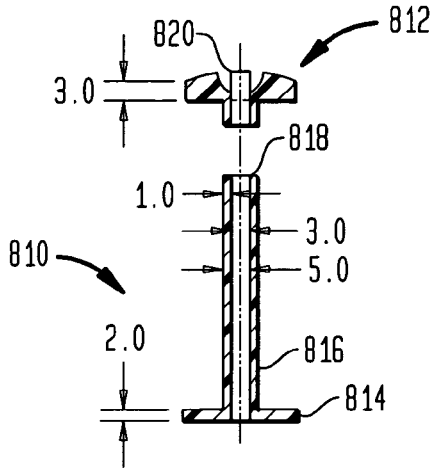
FIGS. 12(*a*)-(*d*) illustrate a toe post for use with the thong sandal of FIGS. 11(*a*)-(*d*).
Figure 12B:
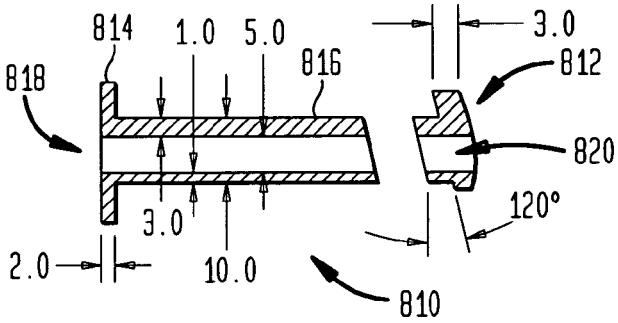
Figure 12C:
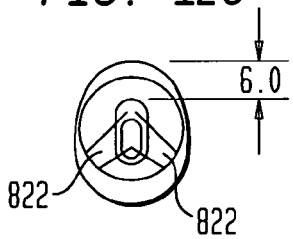
Figure 12D:
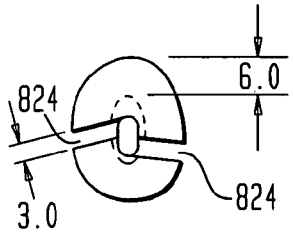

FIG. 8 illustrates a perspective view of an article of footwear 500 generally similar to the article of footwear 400 discussed above. As with the article of footwear 400, the article of footwear 500 has a sandal configuration with the wraparound lacing system. In the embodiment of FIG. 8, the article of footwear 500 comprises an integrally molded unit having outsole 502, housing 504 including an upper and a midsole (not shown), and a footbed 506. The outsole 502 preferably includes a plurality of lugs 503 in place of or in combination with siping. In this unitary structure, the lace 118 may run through channels in or along the outsole 502, or, alternatively, between rows of the lugs 503. The housing 504 preferably comprises IMEVA. The outsole 502 and/or the footbed 506 may also comprise IMEVA so that the article of footwear 500 is formed as a homogeneous structure. Alternatively, the outsole 502 and/or the footbed 506 may be formed of different materials such as those described in other embodiments of the present invention. Nonetheless, in this embodiment, the outsole 502, housing 504 and footbed 506 are formed as a unitary structure. The lacing configurations of this embodiment may be the same as for the other embodiments discussed herein.

FIGS. 9(*a*)-(*h*) illustrate an article of footwear 600 in accordance with another preferred embodiment of the present invention. As seen in the perspective, side, top and bottom views of FIGS. 9(*a*)-(*d*), respectively, the article of footwear 600 has a shoe configuration, such as a wet boot, incorporating the wraparound lacing system described above. As shown, the article of footwear 600 comprises an outsole 602, integrally molded housing 604 including an upper and a midsole (not shown), and a footbed 606. The article of footwear 600 also includes a bootie or sockliner 608.

The bootie 608 is preferably a stretch bootie adapted to fit into the molded upper of the housing 604. The bottom surface 610 (see FIG. 9(*f*)) of the bootie 608 may be bonded to the top surface of the midsole. In this case, the footbed 606 is desirably a removable footbed 606 that can be received into the interior of the bootie 608. Alternatively, the bootie 608 may be removable from the housing 604.

As seen in the perspective view of FIG. 9(*e*) and the front and back views 9(*g*) and 9(*h*), respectively, the bootie 608 may include one or more finger pulls 612, which may be made of webbing. In a preferred embodiment, there are two finger pulls 612, one at the front and one at the back of the collar of the bootie 608. The finger pulls 612 allow the wearer to quickly and easily remove the bootie 608 from the housing 604. If the bootie 608 is bonded to the midsole or otherwise secured to the housing 604, the finger pulls 612 enable the user to pull the article of footwear 600 on easily.

Sidewalls 614 preferably comprise a breathable mesh, such as a coated, hydrophobic, breathable mesh. The breathable mesh is desirably lightweight and waterproof, allowing for added protection of the skin while complementing the features of the EVA upper to provide comfort, contour and a secure fit to the wearer. As shown in the front view of FIG. 9(*g*), medial sidewall 614*a* and lateral sidewall 614*b* need not be the same. Heel section 616 and instep section 618 preferably comprise non-stretch microfiber fabric. The edges 620 of the sidewalls 614 may be strobel stitched to a non-woven lasting board of the bottom 610.

In an alternative example, the bootie 608 may incorporate stretch wovens in conjunction with a form fitting, insulting, waterproof material such as neoprene, which may be utilized with or without an insulating material such as fleece. The insulating material is especially desirable in cold climates. The stretch wovens, waterproof materials and/or the insulating materials provide flexibility, comfort, waterproofing or water resistance, as well as insulation. All of these benefits are available in conjunction with the benefits of the durable, pliable, and protective housing 604.

FIGS. 10(*a*)-(*d*) illustrate an article of footwear 700 in accordance with another preferred embodiment of the present invention. As seen in the side and top views of FIGS. 10(*a*)-(*b*), respectively, the article of footwear 700 preferably has a slide configuration incorporating the wraparound lacing system described above. This style of footwear with a low back area allows for quick entry and exit of the wearer's foot from the article of footwear 700. As shown, the article of footwear 700 comprises an outsole 702, integrally molded housing 704 including an upper and a midsole (not shown), and a footbed 706.

As described above with regard to a preferred embodiment of the article of footwear 100, the lace 118 winds around and through the fingers 112 and between the midsole and the outsole 702. Unlike the configurations above, the slide 700 does not include a heel support. Instead, the slide 700 is open at the rear. Nonetheless, a first end of the lace 118 is desirably knotted and bonded in a recess of the midsole (not shown), thereby anchoring or otherwise securing a first end of the lace 118 to the article of footwear 700 between the midsole and the outsole 702. The second end of the lace 118 is secured or anchored by the lace end keeper 124, which, as seen in FIG. 10(*a*), may be positioned at or near the bottom of the rearmost finger 112 on either the medial or lateral side of the slide 700. Alternatively, the lace end keeper 124 may be positioned anywhere else along the housing 704. A sizing indicator 705 may be screen printed on the inside of one of the fingers 112.

As shown in the top view of FIG. 10(*b*), the footbed 706, which may be integrally molded to the housing 704, may comprise at least two regions 706*a* and 706*b*, although any number of regions 706*n* may be employed. In the illustrated example, the regions 706*a* and 706*b* have different texture. For instance, the region 706*a* may be substantially or generally smooth, while the region 706*b* may be ridged, siped, embossed or otherwise textured.

The present invention provides optimized traction on the bottom of the slide 700 for wet or smooth surfaces. This is achieved through the use of both molded-in siping as well as the addition of siping cut in the opposite direction in the quad cut configuration. The bottom view of FIG. 10(*c*) shows that the outsole 702 may include one or more sections, quadrants, or regions 708. The regions 708 may be separated by spacers 710, which may also include a border around the exterior portion of the outsole 702. Each region 708 may include symbols, logos, size information, style data, source identifiers, designs such as circles or other geometric patterns, etc. Each region 708 may also include structural features such as siping 712 to improve traction on wet surfaces. The siping 712 may be, for example, in a quad cut configuration 712*a* and/or a "waffle cut" configuration 712*b*. The siping 712 may be confined within one or more of the regions 708, or may also be incorporated into the spacers 710. The quad cut siping 712*a* and the waffle cut siping 712*b* and/or other siping configurations may be within the same region 708.

The siped outsole 702 provides traction on wet surfaces through diversion of water from the bottom surface of the outsole 702. The duel siped quad cut areas 712*a* provide optimized surface area contact for the wearer, enhancing the traction of the rubber outsole 702. The quad cut configuration 712*a* is ideally suited for wet and/or smooth surface contact. Optionally, the quad cut configuration can be incorporated into specific areas of the outsole 702, such as the forefoot and the heel, while using more traditional lugs and/or other siping configurations such as the waffle cut 712*b* on the medial/lateral perimeters to optimize for multi-surface use.

FIG. 10(*d*) illustrates a sectional view along the 10A-10A line of FIG. 10(*b*), illustrating the inside lateral portion of the housing 704 of the article of footwear 100. While some details are omitted for clarity, such as the debris shield 146, the interior lacing channels 116 are shown on the inside of the fingers 112 and the lacing channels 116 on the underside of midsole 704*b* are also shown. The midsole 704*b* may include a first region 704$b_1$ of EVA foam having a first density or hardness, and a second region 704$b_2$ of EVA foam having a second density or hardness. One or more second regions 704$b_2$ may be strategically positioned on the surface of the midsole 704*b*, for example beneath the metatarsal and heel regions of the foot to absorb forces applied by these portions of the foot.

FIGS. 11(*a*)-(*c*) illustrate an article of footwear 800 in accordance with another preferred embodiment of the present invention. As seen in the side and top views of FIGS. 11(*a*)-(*b*), respectively, the article of footwear 800 preferably has a flip-flop or thong sandal configuration incorporating the wraparound lacing system described above. As shown, the thong sandal 800 comprises an outsole 802, integrally molded housing 804 including an upper and a midsole (not shown), and a footbed 806. The thong sandal 800 is somewhat similar to the slide 700, although a few differences will become evident.

As described above with regard to a preferred embodiment of the article of footwear 100, the lace 118 winds around and through the fingers 112 and between the midsole and the outsole 802. It can be seen that there are only two fingers 112 on either side of the thong sandal 800, in contrast to the three fingers 112 on either side of the slide 700. However, it should be understood that any number of fingers 112 can be used on either the slide 700 or the thong sandal 800. Some or all of the medial and lateral fingers 112 may be separate or connected together.

As shown in the top view of FIG. 11(*b*), the footbed 806, which may be integrally molded to the housing 804, may comprise at least two regions 806*a* and 806*b*, although any number of regions 806*n* may be employed. The regions 806*a* and 806*b* may be the same configuration as the regions 706*a* and 706*b*. For instance, the regions 806*a* and 806*b* may have different texture. The region 806*a* may be substantially or generally smooth, while the region 806*b* may be ridged, siped, embossed or otherwise textured.

As with the slide 700, the thong sandal 800 does not include a heel support. Instead, thong sandal 800 is open at the rear. In this configuration, an alternative to lace end keepers may be used. For instance, a first end of the lace 118 is desirably knotted and bonded in a first recess of the midsole (not shown), thereby anchoring or otherwise securing the first end of the lace 118 to the thong sandal 800 between the midsole and the outsole 802. Similarly, the second end of the lace 118 is desirably knotted and bonded in a second recess of the midsole (not shown), thereby anchoring or otherwise securing the second end of the lace 118 to the thong sandal 800 between the midsole and the outsole 802.

While lace end keepers are not required, the lace locking mechanism 128 can be used alone or in combination with a lace pull (not shown). In addition to the lace locking mechanism 128, the thong sandal 800 preferably includes a toe post or toe stem 808. The toe stem 808 is preferably a retractable or "floating" toe stem 808. The toe stem 808 can assist in securing the foot within footwear and as an anchor for the wrap lacing system. The floating toe stem 808 preferably allows the upper to travel up or down to secure the forefoot when adjusting the lacing system. Of course, it should be understood that the toe stem 808 can be used in other types of footwear besides the thong sandal 800.

FIGS. 12(*a*)-(*d*) illustrate the toe stem 808 in more detail. The dimensions in these figures are preferred sizes in millimeters, although it should be understood that different size toe stems 808 could be employed. As seen in the front view of FIG. 12(*a*) and the side view of FIG. 12(*b*), the toe stem 808 includes two main parts, namely a base 810 and a top 812. The toe stem 808 is called a floating toe stem because the top 812 is not directly affixed to the base 810. The base 810 includes a pedestal 814 and a tubular body 816. There is an open channel 818 running through the pedestal 814 and the tubular body 816. The top 812 also includes a channel 820 therein. The lace 118 runs through the channels 818 and 820 and connects the top 812 to the base 810, allowing the top 812 to float or move relative to the base 810. Of course, a standard, one-piece toe stem with a hollow core may also be used without presenting significant changes to the lacing system.

FIG. 12(*c*) is a top-down view of the toe stem 808. As shown in this figure, the top 812 of the toe stem 808 may be circular, and preferably includes an angled or "V" shaped recess or depression 822 on the upper surface facing away from the base 810. The recess or depression 822 is designed to receive the lace 118 thereon. As shown in FIG. 12(*d*), the bottom 810 of the toe stem 808 may have an oval shape, and may also include a pair of notches 824 therein. The notches 824 receive portions of the lace 118.

FIG. 11(*d*) illustrates a cutaway view of the thong sandal 800 along the 11A-11A line of FIG. 11(*b*). This cutaway view of the interior lateral side of the thong sandal 800 shows the placement of the toe stem 808 absent the lace 118. As seen in the figure, the pedestal 814 and a lower portion of the tubular body 816 are disposed in midsole 804*b*. The midsole 804*b* may include a first region 804*b*, of EVA foam having a first density or hardness, and a second region 804$b_2$ of EVA foam having a second density or hardness. The toe stem 808 may run through one or both of the first and second regions 804$b_1$ and 804$b_2$. The top 812 of the toe stem 808 is disposed in upper 804*a* of the housing 804, preferably along the finger 112 positioned closest to the toe cover 110.

FIGS. 11(*e*)-(*f*) illustrates cutaway view of the thong sandal 800 along the 11A-11A line of FIG. 11(*b*) showing the interior lateral side and interior medial side, respectively, with the wraparound lace 118. As seen in these figures, the lace 118 runs through the channels 116 and through the toe stem 808. FIG. 11(*g*) illustrates the underside of the midsole 804*b* with the channels 116 therein. The view of FIG. 11(*g*) also shows that the lace 118 may cross over itself within the crossed channels 116.

The present invention provides sturdy articles of footwear that include a wraparound lacing system for superior stability and comfort. The footwear is breathable, and yet may also include an insulated bootie for cold environments. Quad cut siped outsoles provide improved traction. The footwear is suitable for use in all types of environments and with all types of activities, particularly water sports.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims. By way of example only, while different embodiments described above illustrate specific features, it is within the scope of the present invention to combine or interchange different features among the various embodiments to create other variants. Any of the features in any of the embodiments can be combined or interchanged with any other features in any of the other embodiments. For instance, the siping or tread on any given outsole can be used on any of the other outsoles shown herein. Any number of lace keepers may also be used with any of the embodiments, including embodiments without lace end keepers. Furthermore, the debris shield may be included or omitted in each embodiment shown. The invention can be used in combination with new or uncommon materials in addition to the materials specified above, as well as with new or uncommon manufacturing techniques.

The invention claimed is:

1. An article of footwear, comprising:

an outsole having a first surface for contacting the ground and second surface remote from the first surface; and a housing including an integral one piece upper and midsole defining an enclosure for receiving a wearer's foot, the upper having medial and lateral sides and having at least one projection affixed to the midsole on the medial side and at least one projection affixed to the midsole on the lateral side, the upper including a lace channel on the medial side and a lace channel on the lateral side, the midsole having a first surface adjacent the enclosure and a second surface remote from the enclosure and connected to the second surface of the outsole, the housing including a base lace channel positioned below the first midsole surface, the base lace channel coupled to the medial and lateral side lace channels.

2. The article of footwear of claim 1, further comprising an endcap disposed on the upper adjacent to either the medial side lace channel or the lateral side lace channel.

3. The article of footwear of claim 2, wherein a lace is wound through the base lace channel, the medial side lace channel and the lateral side lace channel from a first point of the housing to a second point of the housing to substantially encircle the wearer's foot, and tension of the lace may be adjusted by un-securing the endcap, changing the length of the lace, and re-securing the first end of the lace with the endcap.

4. The article of footwear of claim 2, wherein a lace is wound through the base lace channel, the medial side lace channel and the lateral side lace channel from a first point of the housing to a second point of the housing to substantially encircle the wearer's foot, and tension of the lace may be adjusted by winding or unwinding the lace with the endcap.

5. The article of footwear of claim 2, wherein the endcap is removably disposed on the upper.

6. The article of footwear of claim 2, further comprising a lace wound through the base lace channel, the medial side lace channel and the lateral side lace channel from a first point of the housing to a second point of the housing.

7. The article of footwear of claim 6, wherein a first end of the lace is secured to the first point of the housing by the endcap.

8. The article of footwear of claim 6, wherein the lace is wound in a spiral configuration around the housing.

9. The article of footwear of claim 6, wherein the base lace channel includes a recess at one end thereof for receiving a second end of the lace.

10. The article of footwear of claim 6, wherein the upper further comprises a heel support having a heel lace channel therein, the lace also being wound through the heel lace channel.

11. The article of footwear of claim 6, wherein the base lace channel, the medial side lace channel and the lateral side lace channel each comprise a plurality of lace channels, the lace being wound through each of the base, medial side and lateral side lace channels.

12. The article of footwear of claim 7, further comprising a second endcap for securing a second end of the lace, the first endcap being disposed on the upper adjacent to a first one of the medial or lateral side lace channels, and the second endcap being disposed on the upper adjacent to a second one of the medial or lateral side lace channels.

13. The article of footwear of claim 12, further comprising a midpoint cap disposed on the upper adjacent to a second one of the medial or lateral side lace channels between the first and second endcaps, wherein a first segment of the lace between the first endcap and the midpoint cap has a first lace pressure and a second segment of the lace between the midpoint cap and the second endcap has a second lace pressure.

14. The article of footwear of claim 11, wherein the medial and lateral projections each comprise a plurality of projections, each of the medial side projections including a corresponding one of the medial side lace channels and each of the lateral side projections including a corresponding one of the lateral side lace channels.

15. The article of footwear of claim 14, wherein the number of medial side projections is different from the number of lateral side projections.

16. The article of footwear of claim 1, wherein the second surface of the outsole is bonded to the second surface of the midsole with a bonding agent, the base lace channel is disposed in the second surface of the midsole, and the second surface of the outsole includes a bonding identifier positioned complementary to the base lace channel to identify a region of the second surface of the outsole that is not coated with the bonding agent.

17. The article of footwear of claim 1, wherein the base lace channel is molded into the second surface of the midsole and the second surface of the outsole includes a molded channel aligned with the base lace channel.

18. The article of footwear of claim 1, wherein a first portion of the medial side lace channel is disposed along an outer surface of the medial side projection and a second portion of the medial side lace channel is disposed along an inner surface of the medial side projection, and a first portion of the lateral side lace channel is disposed along an outer surface of the lateral side projection and a second portion of the lateral side lace channel is disposed along an inner surface of the lateral side projection.

19. The article of footwear of claim 18, wherein the base lace channel connects to the medial and lateral side lace channels to form a continuous lace channel.

20. An article of footwear, comprising:

an outsole having a first surface for contacting the ground and second surface remote from the first surface;

a housing including an integral one piece upper and midsole defining an enclosure for receiving a wearer's foot, the upper having at least one medial side projection and at least one lateral side projection extending away from the midsole, the at least one medial and lateral side projections each including a channel therein, the midsole having a first surface remote from the enclosure and connected to the second surface of the outsole, the midsole including at least one channel therein, the at least one midsole channel connecting to the at least one medial channel and the at least one lateral side channel; and a lace wound through the at least one midsole channel, the at least one medial side channel and the at least one lateral side channel from a first point of the housing to a second point of the housing to generally surround and encircle the wearer's foot, a first end of the lace being secured to a first connection point on the housing and a second end of the lace being secured to a second connection point on the housing.

21. The article of footwear of claim 20, wherein the article of footwear is a water shoe.

22. The article of footwear of claim 20, wherein the first and second connection points are disposed in the midsole.

23. The article of footwear of claim 20, further comprising an endcap disposed on the upper adjacent to one of the medial side channel or the lateral side channel for securing the first end of the lace at the first connection point.

24. The article of footwear of claim 23, wherein the endcap is coupled to the upper so that tension of the lace may be adjusted.

25. The article of footwear of claim 23, further comprising a lace keeper removably coupled to the lace adjacent to one of the medial or the lateral side channels between the first and second connection points for adjusting tension of the lace.

26. The article of footwear of claim 20, wherein the outsole is integrally molded with the housing to form a one piece outsole and housing.

27. The article of footwear of claim 20, further comprising a stiffening member disposed between the midsole and the outsole.

28. The article of footwear of claim 20, wherein the first surface of the outsole includes quad cut siping for wet and dry traction.

29. The article of footwear of claim 20, wherein the upper includes an integral toe guard that substantially covers the toes of the wearer's foot, whereby the toe guard and other portions of the upper comprise a one piece structure.

30. The article of footwear of claim 29, wherein the toe guard includes a screen disposed over a ventilation hole to prevent entry of debris into the enclosure.

31. The article of footwear of claim 20, further comprising a footbed for contacting the wearer's foot, the footbed being disposed in the enclosure over a second surface of the midsole.

32. The article of footwear of claim 31, wherein the footbed is removable.

33. The article of footwear of claim 31, wherein the footbed and the midsole form an integral one piece unitary structure.

34. The article of footwear of claim 20, further comprising a toe stem including a base and a separate top, the base having a pedestal disposed in the midsole and a tubular body connected to the pedestal, the top being disposed in one of the medial side projection or the lateral side projection and having a through-hole therein, whereby the lace is run through the tubular body of the base and the through-hole of the top to connect the base and the pedestal.

35. An article of footwear, comprising:

an outsole having a first surface for contacting the ground and second surface remote from the first surface;

a housing including an integral one piece upper and midsole defining an enclosure for receiving a wearer's foot, the upper having a heel support, a toe cover and a plurality of medial side projections and a plurality of lateral side projections extending away from the midsole, at least some of the medial and lateral side projections including channels therein, the heel support including a channel therein, the midsole having a first surface adjacent the enclosure and a second surface remote from the enclosure and connected to the second surface of the outsole, and the midsole including a plurality of channels therein;

a lace wound generally in a spiral pattern through the heel support channel, the midsole channels, the medial side channels and the lateral side channels from a first point of the housing to a second point of the housing to generally surround and encircle the wearer's foot, a first end of the lace being positioned at a first connection point on the housing and a second end of the lace being positioned at a second connection point on the housing;

a footbed disposed over the first surface of the midsole; and an endcap disposed on the upper adjacent to one of the medial side or lateral side channels at the first connection point, the first end of the lace being secured at the first connection point by the endcap.

36. The article of footwear of claim 35, further comprising:

a bootie generally disposed within the enclosure and adapted to substantially encompass the wearer's foot, the bootie including a bottom surface positioned over the midsole and sidewalls attached to the bottom surface, wherein the footbed is removably positioned within the bootie.

37. The article of footwear of claim 36, wherein the bootie is removable.

38. The article of footwear of claim 36, wherein the bootie further includes at least one finger pull that enables the wearer to pull the article of footwear on or off or to remove the bootie from the article of footwear.

39. The article of footwear of claim 36, further comprising at least one of a lace pull and a lace lock attached to the lace, the lace pull being operable to secure a portion of the lace to the article of footwear and the lace lock being operable to adjust tension of the lace.

* * * * *

UNITED STATES PATENT AND TRADEMARK OFFICE

CERTIFICATE OF CORRECTION

PATENT NO. : 7,287,342 B2
APPLICATION NO. : 11/182970
DATED : October 30, 2007
INVENTOR(S) : Martin Keen It is certified that error appears in the above-identified patent and that said Letters Patent is hereby corrected as shown below:

Column 2, line 22, “wrap” should read --wrap-around--
Column 4, line 53, “including channels” should read --include channels--
Column 20, line 20, “claim 7,” should read --claim 11,--

Signed and Sealed this

Eleventh Day of November, 2008

JON W. DUDAS
*Director of the United States Patent and Trademark Office*